US006550878B2

(12) United States Patent
Nott et al.

(10) Patent No.: US 6,550,878 B2
(45) **Date of Patent: *Apr. 22, 2003**

(54) OVERHEAD STORAGE DEVICE

(75) Inventors: Bruce E. Nott, 701 Lida Park Dr., Newport Beach, CA (US) 92663; Steve S. Adkinson, Santa Monica, CA (US); John W. Goodin, Coto de Caza, CA (US); Joseph Richard Garrison, Garden Grove, CA (US)

(73) Assignee: Bruce E. Nott, Costa Mesa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/084,703

(22) Filed: Feb. 26, 2002

(65) Prior Publication Data

US 2002/0079792 A1 Jun. 27, 2002

Related U.S. Application Data

(63) Continuation of application No. 09/694,939, filed on Oct. 23, 2000, now Pat. No. 6,357,842, and a continuation-in-part of application No. 09/484,308, filed on Jan. 18, 2000, now Pat. No. 6,354,682.

(60) Provisional application No. 60/214,134, filed on Jun. 26, 2000, and provisional application No. 60/117,223, filed on Jan. 25, 1999.

(51) Int. Cl.[7] ..... A47F 5/08

(52) U.S. Cl. ..... 312/248; 52/39

(58) Field of Search ..... 312/248, 245, 312/246, 319.5, 319.7, 319.8; 52/39

(56) References Cited

U.S. PATENT DOCUMENTS

| | | | | |
|---|---|---|---|---|
| 1,677,544 | A | 7/1928 | Brainard et al. | |
| 2,435,755 | A | 2/1948 | Schimpff | |
| 3,019,070 | A | 1/1962 | Diebold | |
| 3,331,645 | A | 7/1967 | Vercellotti | |
| 3,627,397 | A | 12/1971 | Rominsky | |
| 4,026,434 | A | 5/1977 | Howard | |
| 4,699,437 | A | 10/1987 | Genereaux | |
| 5,242,219 | A | 9/1993 | Tomaka | |
| 5,407,261 | A | 4/1995 | Mercer | |
| 5,456,529 | A | 10/1995 | Cheung | |
| 5,460,280 | A | 10/1995 | Feddeler | |
| 5,595,028 | A | 1/1997 | Handzlik | |
| 5,628,153 | A | 5/1997 | Fontanez | |
| 5,725,293 | A | 3/1998 | Wilkening et al. | |
| 6,088,239 | A | 7/2000 | Zeiss | |
| 6,354,682 | B1 * | 3/2002 | Nott et al. | 312/248 |

* cited by examiner

*Primary Examiner*—John G. Weiss
*Assistant Examiner*—Michael J. Fisher
(74) *Attorney, Agent, or Firm*—Knobbe, Martens, Olson & Bear, LLP

(57) ABSTRACT

An overhead storage device includes a storage container that is pivotably or rotatably mounted to an overhead surface, such as a ceiling or a plurality of rafters. The storage container is generally moved by a motorized actuator assembly. The motorized actuator assembly can comprise a worm drive and follower nut arrangement or a flexible transmitter and spool assembly. The storage container is supported by a frame assembly and is secured to the frame assembly generally at an end of the storage container. The overhead storage device is sized to allow a motor vehicle to fit below a raised storage container in an average height garage. The storage container is assembled from two generally identical halves that are nestable for shipping and storage.

19 Claims, 17 Drawing Sheets

OVERHEAD STORAGE DEVICE

CROSS-REFERENCE TO RELATED APPLICATIONS

The present application is a continuation of U.S. patent application Ser. No. 09/694,939, filed on Oct. 23, 2000, now U.S. Pat. No. 6,357,842 which claimed priority to, and expressly incorporated by reference, U.S. Provisional Patent Application No. 60/214,134, filed Jun. 26, 2000 and which was a continuation-in-part of U.S. patent application No. 09/484,308, filed Jan. 18, 2000 now U.S. Pat. No. 6,354,682, which claimed priority to, and expressly incorporated by reference, U.S. Provisional Application No. 60/117,223, filed Jan. 25, 1999. Each of these applications is expressly incorporated by reference.

BACKGROUND OF THE INVENTION

1. Field of the Invention

The present invention generally relates to storage devices. More specifically, the present invention relates to storage devices adapted to be attached to ceilings.

2. Related Art

Older homes often have been thought of as having large amounts of storage space provided within their floor plans. Such homes often included enlarged storage closets, basements and attics. Moreover, such homes had open rafters and walls in the garages. Accordingly, sufficient space was made available for storing all sorts of items. Seldom used items were often relegated to an attic, a basement or another out of the way location during periods of nonuse. More often used items were placed in more easily accessible locations, such as coat closets and the like.

In view of rising real estate costs, however, more recent home designs have emphasized maximizing livable floor space. This has resulted in a drastic reduction of available storage space. Even where storage space is available, items previously stored in easily accessed locations are being pushed into the spaces typically reserved for seldom-used items. For instance, even in newly constructed homes, a two car garage often may be sized according to the footprint of two cars. Thus, even the garage has minimal space for storage of miscellaneous items if the garage is to be used for storing vehicles. Therefore, the seldom-used miscellaneous items are being displaced. Such displacement often means selling or otherwise disposing of such seldom used items.

Moreover, homeowners often desire out of the way locations for storing such things as paint cans, camping gear, sports gear, balls, skis, garden tools and the like. Such items are difficult to store and often create a cluttered appearance when placed on shelves or on the walls of a garage. When stowing such items, overhead lifting of boxes that contain such items can be a difficult and hazardous endeavor.

One difficulty with remedying such storage deficiencies is the design and installation of a storage device. Many prior storage devices are complicated in design, difficult to install and, depending upon their location, difficult to access. Installation charges inflate the cost of storage solutions and stores catering to do-it-yourselfers often may refuse to carry very complicated systems. Thus, a need exists for a simple storage device that is easy to install.

SUMMARY OF THE INVENTION

Accordingly, it is desired to provide a storage device that allows items to be stored in an out of the way location. Such an out of the way location, however, desirably is easily accessed. Moreover, the storage device should present a simple yet relatively hands-free manner of accessing stored items. In this manner, the storage device can be used by persons of all ages and physical strength levels. Moreover, the storage device should be simple in design and easy enough for average individuals to install themselves.

Therefore, one aspect of the present invention involves an overhead storage device comprising a storage container. A frame is pivotably connected to the storage container and adapted to be connected to an overhead surface. The storage container includes at least one sidewall and a bottom wall. A reference plane is defined generally parallel to the bottom wall and extends through the at least one sidewall. A motorized actuator is connected to the storage container and the motorized actuator is capable of controllably pivoting the storage container relative to the frame such that the reference plane moves between a generally horizontal position and a generally vertical position.

Another aspect of the present invention involves an overhead storage device comprising a storage container and a mounting assembly that is adapted to movably secure the storage container to an overhead surface. A motorized actuating assembly at least partially controls the movement of the storage container between a generally open position and a generally closed position. The storage container comprises at least one sidewall and a bottom wall with a plurality of ribs reinforcing the bottom wall. An intersecting grid of channels extends along the sidewall and the bottom wall with the grid configured to removably receive dividing panels whereby the storage container may be subdivided into individual compartments.

A further aspect of the present invention involves a method of assembling an overhead storage device. The method generally comprises positioning a mounting board on an overhead surface. The mounting board is secured to the overhead surface. One also positions and secures components of a frame on the mounting board by using the mounting board as a template. The method also involves assembling a storage container and mounting the storage container to the frame. The method further involves connecting a motorized actuator to the container.

Another aspect of the present invention involves an overhead storage device that comprises a storage container. The storage container comprises at least one sidewall and a bottom wall, and a reference plane defined generally parallel to the bottom wall and extending through the at least one sidewall. The storage device further comprises a frame pivotably connected to the storage container and adapted to be connected to an overhead surface, and a motorized flexible transmitter-and-spool system interconnecting the storage container and the overhead surface. The flexible transmitter-and-spool system is capable of controllably pivoting the storage container relative to the frame such that the reference plane moves between a generally horizontal position and a generally vertical position.

Yet another aspect of the present invention involves an overhead storage device comprising a storage container, a mounting assembly adapted to movably secure the storage container to an overhead surface, and a motorized belt-and-spool system at least partially controlling the movement of the storage container between a generally open position and a generally closed position.

Still another aspect of the present invention involves a method of assembling an overhead storage device. The method generally comprises securing a frame to an overhead surface, mounting a storage container having a built-in motor to the frame, and interconnecting the container to the frame via at least one belt drivably connected to the motor.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which.

DETAILED DESCRIPTION OF THE PREFERRED EMBODIMENTS OF THE INVENTION

Figure 1:
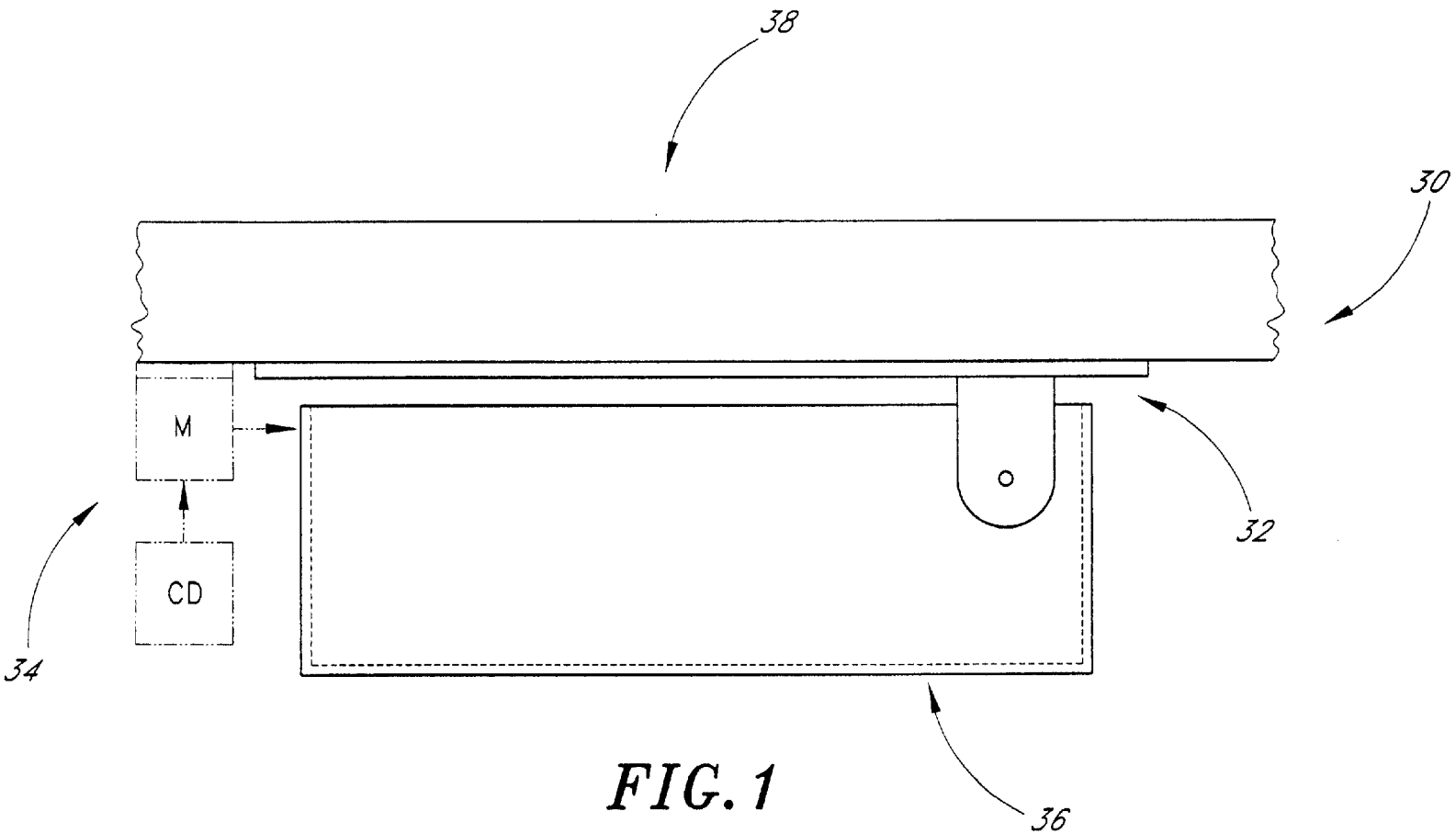
FIG. 1 is a schematic diagram of an overhead storage device having certain features, aspects and advantages in accordance with the present invention.

With initial reference to FIG. 1, an overhead storage device, indicated generally by the reference numeral 30 is schematically illustrated therein. As shown, the overhead storage device 30 is basically comprised of a mounting assembly 32, an actuating assembly 34 and a storage container 36. The mounting assembly 32 preferably suspends the storage container 36 from a mounting surface 38, such as a ceiling or a rafter arrangement of a room, an attic, a garage, or the like. The actuating assembly 34, in association with the mounting assembly 32, drives the container through a pivotal or rotational path of travel relative to the mounting surface. The actuating assembly 34 advantageously includes a motor M for positively controlling the position of the storage container 36. In general, the actuating assembly 34 moves the storage container 36 between a generally vertical position, considered an opened position, in which position the storage container 36 may be loaded or unloaded, and a generally horizontal position, considered a closed position, in which position the storage container cradles the stored items.

With reference now to FIGS. 2–7, the overhead storage device 30, which has certain features, aspects and advantages in accordance with the present invention, will be described in detail. The mounting assembly 32 of the present overhead storage device will be described first. The illustrated mounting assembly 32 generally comprises a hanging board 40 and a frame 42. Of course, one of ordinary skill in the art will readily recognize that additional components also may be added to the illustrated assembly 32 to vary the mounting configuration; however, the illustrated assembly 32 is advantageously simple in construction.

The hanging board 40 preferably is a standard sheet of material having an adequate thickness to carry the weight of the assembled and fully loaded storage container 36. As will be recognized, a standard sheet of material typically measures approximately four feet in width by eight feet in length or four feet in width by ten feet in length. While sheets having other sizes may be used, the standard sheet size reduces labor and manufacturing costs. In addition, individual strips can also be used in some arrangements. In one embodiment, the hanging board 40 is plywood having a thickness of approximately 0.375 inch or more. In another embodiment, a sheet of fiberboard having a thickness of 0.5 inch is used. Other structural materials, such as, for instance, but without limitation, metals, woods, laminates, plastics, and the like also can be used as a hanging board. Importantly, the hanging board 40 advantageously allows the present mounting assembly 32 to be supported by a ceiling or rafter assembly without regard to the location of the storage device 30 relative to the supporting studs or rafters. Specifically, the hanging board 40 is secured to the rafters in a desired location and the balance of the presently preferred storage device 30 is mounted to the hanging board 30. Significantly, this permits a single standard storage device to be used in virtually any environment, thus, greatly reducing manufacturing and installation time and costs.

As mentioned above, the frame 42 preferably is adapted to hang the overhead storage device 30 from the hanging board 40. It is anticipated, however, that the frame 42 also can be directly attached to rafters in some embodiments. The frame, best illustrated in FIGS. 6 and 7A, generally comprises roller tracks 50 and support brackets 52. The roller tracks 50 have a first end, a second end and a portion with a generally c-shaped cross section that preferably extends between the first end and the second end such that a roller (discussed in detail below) is substantially captured within the roller track 50. While the illustrated roller tracks have a c-shaped portion, other configurations, such as V-tracks with rollers having V-grooves, for instance, may also be used. In addition, the tracks 50 can have rolled or radiused internal corners to help center the roller in the track 50 during movement.

Figure 7A:
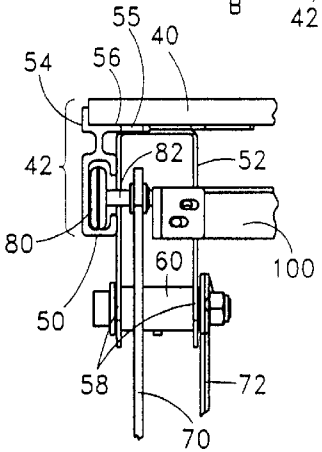
FIG. 7A is an enlarged front elevation view of a corner of the portion of the overhead storage device within 7A—7A in FIG. 7.

With reference now to FIG. 7A, the roller tracks 50 also comprise a mounting flange 54. The mounting flange 54 may be any number of shapes, such as a straight flange or an L-shaped flange, for instance. Preferably, the mounting flange 54 extends along an outer edge of a hanging board 40 (if used) to accurately space the two roller tracks 50 apart from one another. Additionally, the mounting flange 54 may contain a plurality of apertures 55 (shown in FIG. 7*a*). Fasteners, such as lag screws or the like, may be used to attach the roller tracks 50 to the hanging board 40 or directly to framing components of a building. Thus, a mounting surface 56 which is generally parallel to the ceiling and hanging board is preferably formed with the apertures to take advantage of the increased structural strength of the mounting board that exists in this plane. Of course, other mounting arrangements, such as clamps and the like, may also be used to hang the roller tracks 50. In addition, while the illustrated track 50 is segmented (i.e., formed in two end-to-end pieces), the track also can be made in one or more than two pieces; however, shortening the pieces to some extent is useful in compactly packaging the assembly for shipping and storage prior to sale.

Figure 4:
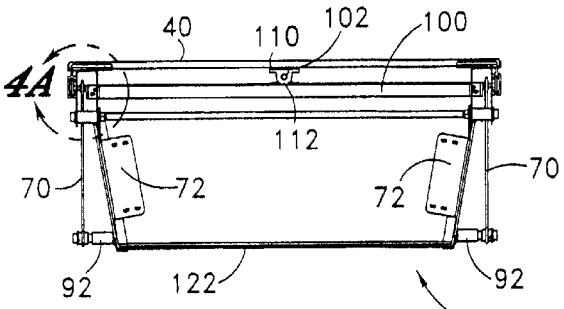
FIG. 4 is a rear elevation view of the overhead storage device of FIG. 2, wherein the overhead storage device is in a closed position.
Figure 4A:
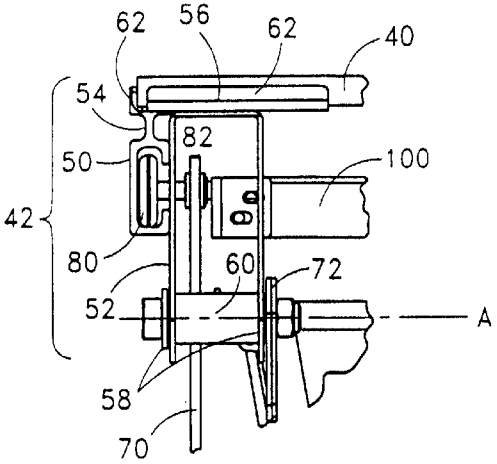
FIG. 4A is an enlarged rear elevation view of a corner of the overhead storage device taken about the line 4A—4A in FIG. 4.
Figure 5:
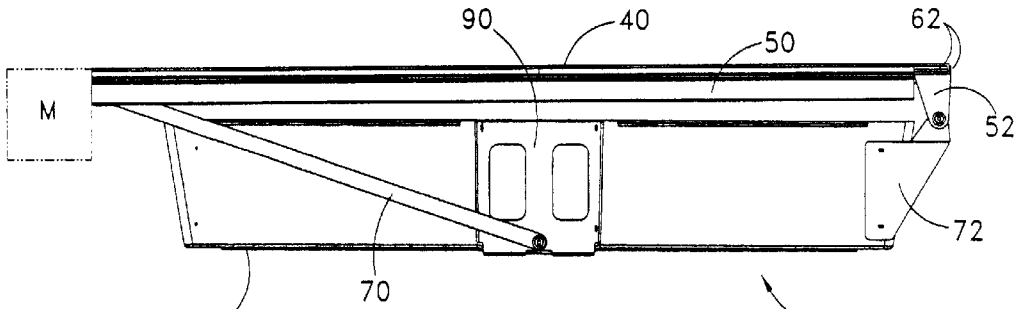
FIG. 5 is a side elevation view of the overhead storage device of FIG. 2, wherein the overhead storage device is in a closed position.
Figure 3:
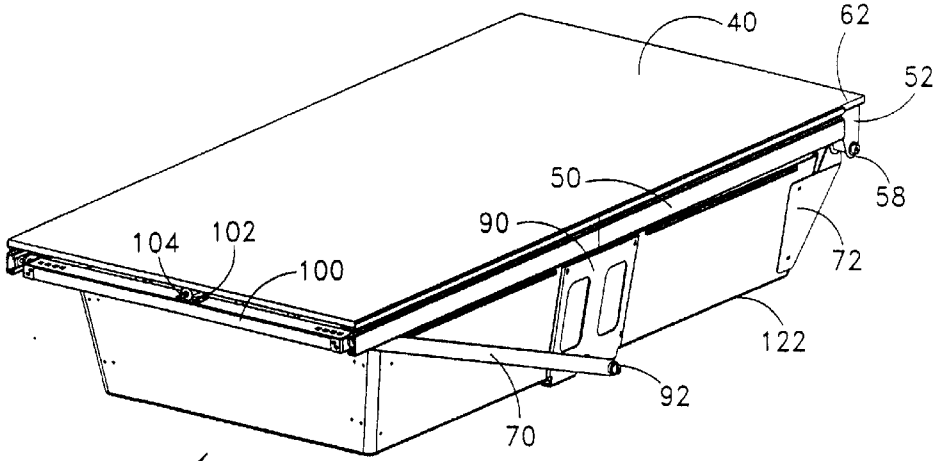
FIG. 3 is a perspective view of the overhead storage device of FIG. 2, wherein the overhead storage device is in a closed position.

With reference now to FIGS. 3, 4A and 5, the illustrated support bracket 52 is generally U-shaped with a downward facing opening defined between two legs. In the illustrated arrangement, the support bracket 52 is formed as a distinct component, separate from the roller tracks 50. In some embodiments, however, the support bracket 52 may be formed integrally with the roller tracks 50 to reduce the number of components required to be attached. While a number of other bracket configurations also are envisioned, the general U-shape of the presently preferred bracket 52 allows for a more even distribution of forces to the hanging board 40 by removing at least a portion of the twisting moments created by an off-center mounting of the container 36. As illustrated, the bracket 52 also comprises a pair of aligned apertures 58. A support tube 60 may be positioned within the bracket 52, and preferably extends through the apertures 58, to support a portion of the container 36 in a manner to be described below. The support tube 60 generally defines a pivot axis A (FIG. 4A) of the container 36 relative to the mounting assembly 32 and may receive a loaded pivot arm, which will be described in greater detail below.

With continued reference to FIGS. 3 and 4A, the support bracket 52 also preferably includes flanges 62. The flanges 62 operate to capture a corner of the hanging board 40 in the illustrated embodiment. In this manner, the flanges aid in positively positioning the support bracket 52 relative to the roller tracks and the balance of the overhead storage device 30. The flanges 62 may extend up to the entire thickness of the hanging board 40. While the illustrated flanges 62 capture substantially the entire corner of the hanging board, it is also envisioned that the flanges 62 may capture only portions of the comer or capture only one side of the hanging board 40.

Figure 6:
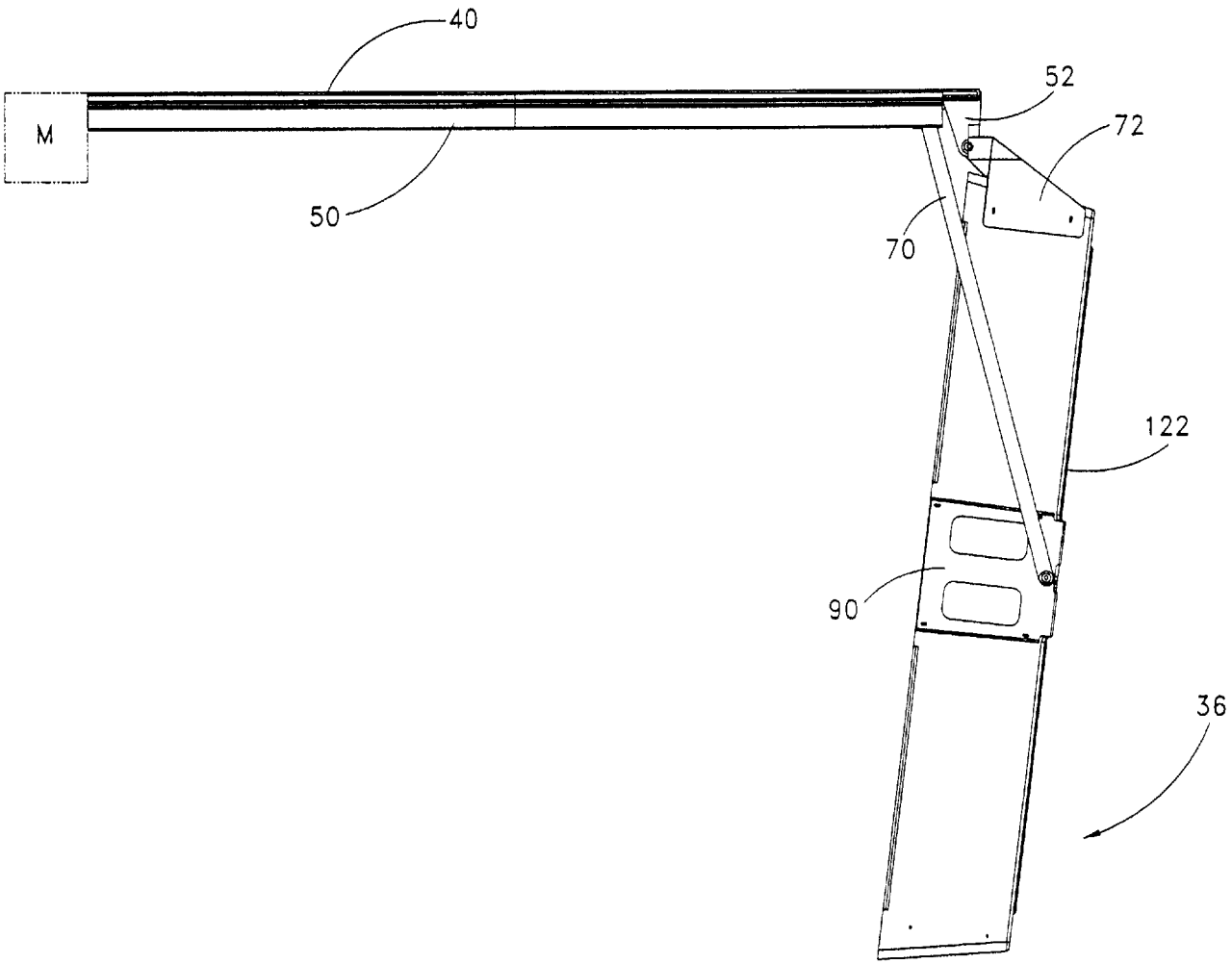
FIG. 6 is a side elevation view of the overhead storage device of FIG. 2, wherein the overhead storage device is in an opened position.

With reference now to FIGS. 5 and 6, the container 36 is generally supported by a pair of control arms 70 and the support rods 60 that couple a pair of corner brackets 72 to the corresponding support brackets 52. The corner brackets 72 generally comprise a plate with an aperture 74 arranged to substantially correspond to the location of the support tube 60 when the container 36 is mounted to the mounting assembly 32. Preferably, the corner brackets 72 also are formed in a generally L-shaped configuration such that the corner brackets 72 can reinforce the corners of the container 36. The corner brackets 72 may be attached to the container 36 in any suitable manner, including the use of threaded fasteners, welding, where possible and the like.

With reference now to FIGS. 5 and 6, the control arms 70 generally extend between a middle location on the container 36 (i.e., between the ends of the container) and the roller tracks 50. The middle location is desirably spaced about one-half of the length of the container from each end of the container to balance weight and stress. With reference now to FIG. 4A, a roller track end of each control arm 70 carries at least one roller 80 that is sized and configured to operate within the roller track 50. The rollers 80 may be made of any suitable material, including a resilient nylon material. Moreover, the rollers 80 may be attached to the support rods in any suitable manner. In the illustrated embodiment, the rollers 80 are attached to a fixed axle 82 that is welded to the control arm 70. Of course, the roller 80 is mounted to the axle 82 with appropriate bearings where necessary. Moreover, the roller 80 may be attached to a rotatable axle in some embodiments while the rotatable axle may be journaled by the support rod 80.

With reference now to FIG. 5, an opposite end of each control arm 70 from the roller track 50 is pivotably secured to a central portion of the container 36. In the illustrated embodiment, each control arm 70 is fixed to a central support bracket 90. The central support bracket 90 preferably spans a joining line between two portions of the container 36, which may be joined in a manner to be described in detail below. Preferably, the central support bracket 90 includes a mounting shaft 92 (see FIG. 2) that extends outward from the sides of the container 36. The mounting shaft 92 should extend a sufficient distance outward to allow the control arms 70 to adequately clear the sides of the container 36. The control arms 70 may also be bent to allow the mounting shafts 92 to be shortened while still allowing the control arms 70 to clear the sides of the container 36 throughout the range of motion of the control arms 70. In the presently preferred arrangement, the container 36 is supported at one end and in a generally central location such that the container can be controllably pivoted about the supported end. It is also envisioned that the container could be supported in a more central location to allow the container to rotate somewhat about a pivot axis; however, the presently preferred arrangement advantageously increases the clearance below the container while decreasing the necessary amount of clearance above the container.

Figure 7:
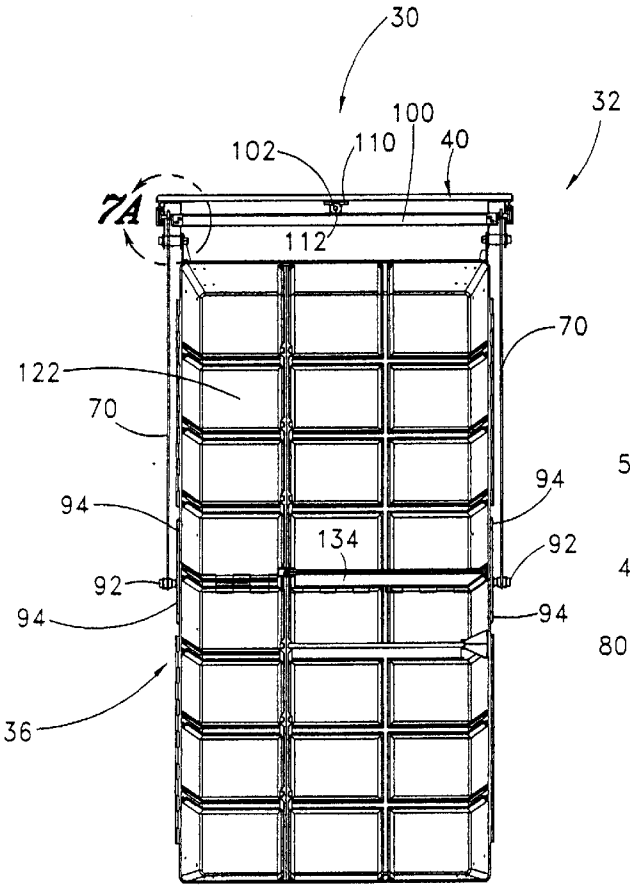
FIG. 7 is a front elevation view of the overhead storage device of FIG. 2, wherein the overhead storage device is in an opened position.
Figure 8:
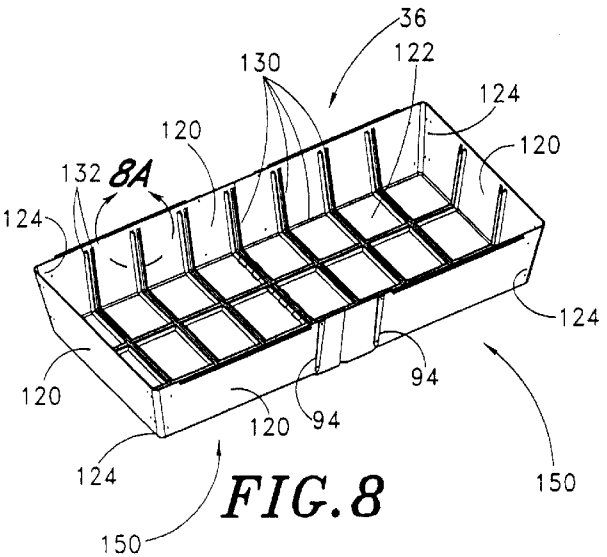
FIG. 8 is a perspective view of a storage container having certain features, aspects and advantages in accordance with the present invention.

With reference to FIGS. 7 and 8, the central support bracket 90 may be attached to the container 36 along at least one, but preferably two elongated bosses 94. Threaded fasteners also may be used to secure the central support bracket 90 to the container 36. In some embodiments, the support bracket 90 may be attached to the bosses 94 through a standard tongue and groove type of configuration. The presently preferred bosses 94 advantageously allow loading forces to be distributed more evenly to the central support bracket 90 by reducing the stress concentration commonly associated with simple threaded fastener connections.

Figure 2:
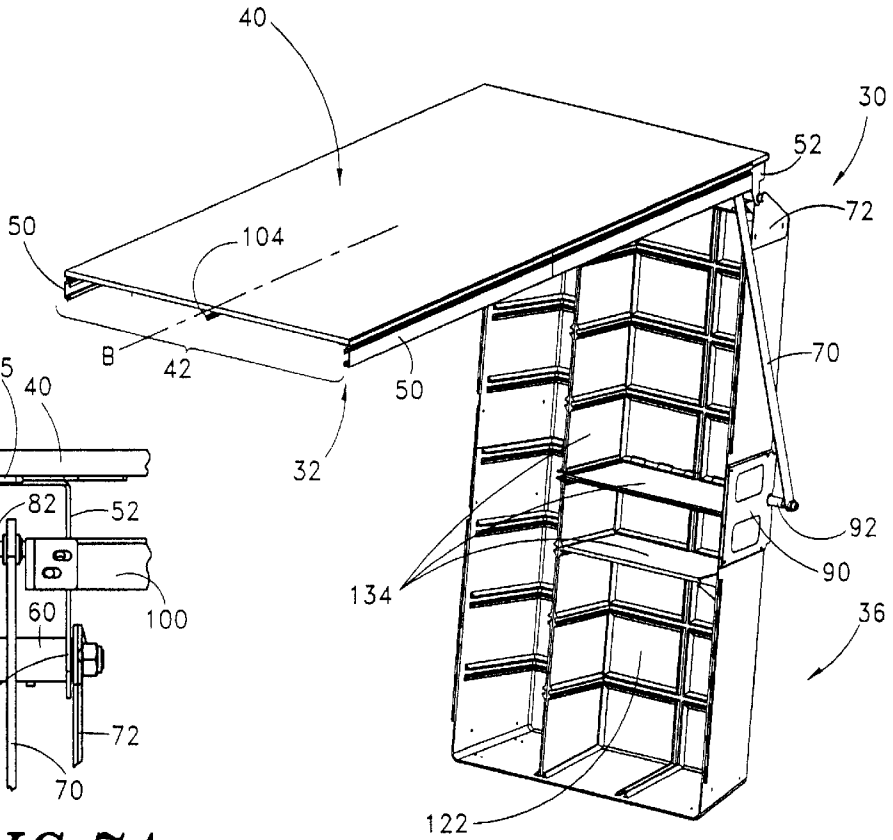
FIG. 2 is a perspective view of an overhead storage device configured and arranged in accordance with certain features, aspects and advantages of the present invention, wherein the overhead storage device is in an opened position.

With reference now to FIGS. 2–3 and 6, the actuating assembly 34 of the illustrated embodiment will be described in detail. In general, the actuating assembly 34 comprises a cross axle 100, a follower assembly 102, a worm drive 104 and a motor M. The cross axle 100 preferably connects the rollers 80 and spans the width between the two roller tracks 50. The cross axle 100 may be connected to the rollers 80 or the control arms 70 in any suitable manner. In one embodiment, the cross axle 100 is square tubing that is connected to each of the arms 70 with a bracket such that the arms 70 may pivot relative to the cross axle 100. The presently preferred cross axle encourages the rollers 80 and control arms 70 to move substantially synchronously.

With reference now to FIG. 4, the cross axle 100 supports the follower assembly 102 at a location along the cross axle 100 that is generally positioned between the arms 70. The follower assembly 102 preferably is positioned in a central location between the two arms 70. In general, the follower assembly 102 comprises an abutment 110 that is secured to the cross axle 100 in any suitable manner, including welding or with brackets. The presently preferred abutment carries a follower nut 112 that is sized and configured to translate along the worm drive 104 when the worm drive 104 is rotated. The follower nut is preferably manufactured from Teflon, brass or another lubricious material such that the worm drive and the follower nut are less prone to seizure. It is also envisioned that the worm drive may be periodically lubricated to reduce the likelihood of seizure or galling between components. Preferably, the centerline of the follower nut 112 is approximately centered between the two control arms 70. By relatively centrally locating the follower nut 112, the forces distributed to each side of the actuator assembly and mounting assembly are approximately equal, thereby reducing relative torsion forces between each side.

With continued reference to FIGS. 2 and 4, the worm drive 104 is preferably journaled to rotate about an axis B that extends parallel to the roller tracks 50. The worm drive 104 preferably comprises a threaded rod having a diameter of between about 0.875 inch and about 1.125 inch with a thread pitch of between about 4 and about 6. In one embodiment, the threaded rod has a major diameter of about 1 inch with a pitch of about 5. Of course, other size rods and other thread pitches can be used; however, the presently preferred pitch was chosen to allow the worm drive 104 to move the load at a steady rate without undue forces being transmitted to the motor M. In addition, the rod size preferably is chosen to reduce rod whip during rotation and rod sag between successive rotations. Preferably, the worm drive is segmented and spliced together. In the illustrated arrangement, a pin or connecting rod couples two adjacent worm drive segments together in a manner that leaves the thread substantially uninterrupted. Of course, other joining techniques known to those of ordinary skill in the art also can be used.

The worm drive 104 is operatively connected to the motor M such that the motor M can rotate the worm drive 104 in a first direction to move the abutment and the follower nut forward and in a second direction to move the abutment and the follower nut rearward. The motor can be mounted at any location. Preferably, the motor is mounted inline with the drive to simplify the coupling. More preferably, the motor is mounted inline with the drive at the end of the track 70 opposite the bracket 52. While other methods of driving the container between positions are also possible, the worm drive configuration is one of the more efficient configurations. For instance, a strap could be attached to a portion of the container 36 and attached to a winding rod. A motor could power the winding rod to draw the container 36 upward and to allow the container to return downward. Such a configuration would result in positive control only on the force moving the container upward as the belt cannot exert compressive forces. In some arrangements, however, it is envisioned that the belt could be connected to the container from two different directions to give the desired positive control of movement in both directions. Importantly, the present worm drive provides positive control of the container throughout both the opening process and the closing process.

It is anticipated that an actuator that simulates a worm and gear arrangement can also be used. One example of such an actuator is a Roh'lix® Zeromax actuator. This actuator converts rotary motion into linear motion using rolling element ball bearings that trace a helix pattern along a smooth shaft. The smooth shaft can be a rod or a tube. The actuator comprises a number of preloaded bearings that contact the shaft at an angle. When the shaft is rotated, the bearings trace out an imaginary screw thread. The thrust can be adjusted by adjusting an internal spring force. When the thrust setting is exceeded, the actuator can slip on the shaft until the source of the overload is corrected. The actuator generally has thrust capacities ranging from about 15 to about 200 pounds and can accommodate shaft diameters ranging from about 0.375 inch to about 2 inches. The actuator has leads ranging from about 0.025 to about 6.00 inches. The Roh'lix® actuator allows the drive to slip should the container 36 be overloaded or should a problem develop within the drive, for instance. In addition, the travel time of the container between a loading position and a storing position can be customized per the application.

The motor M is preferably electric. More preferably, the motor M is powered by 110-volt power. One example of a presently preferred motor is one such as that used in a treadmill or on a hospital bed. The motor is preferably a medium speed, high torque motor. For instance, the motor can turn at a rate between about 400–1100 rpm in some applications, depending at least in part upon the screw pitch. In one embodiment, the motor may have rotational braking to ensure that the container cannot move unless intended. In another embodiment, the inertial forces in the system operate to brake movement to accomplish the function of a brake. It is also envisioned that any of a variety of latching mechanisms can secure the container in any desired position.

With reference to FIGS. 5 and 6, two positions of the container generally are depicted. As illustrated, the arms 70 pivot about a central location 92 on the container 36. The rollers 80 allow the upper end of the arms 70 to translate along the roller tracks 50 generally from one end of the container 36 to the other. During the translation of the rollers 80 in the illustrated embodiment, the container 36 pivots about its pivotably fixed end and an angle of the arms 70 relative to the roller tracks 50 generally increases without passing through a position which defines a right angle relative to the tracks. Preferably, in one embodiment, at one extreme of container movement in the illustrated embodiment, a first angle, which is defined between the back wall 122 of the container 36 and the arms 70 is generally the same as a second angle defined between the back wall 122 of the container 36 and the arms 70 at the other extreme of container movement. More preferably, the container pivots through an arcuate path of between about 30 degrees and 95 degrees. In the illustrated embodiment, the container 36 pivots through an arcuate path of about 85 degrees.

Figure 9:
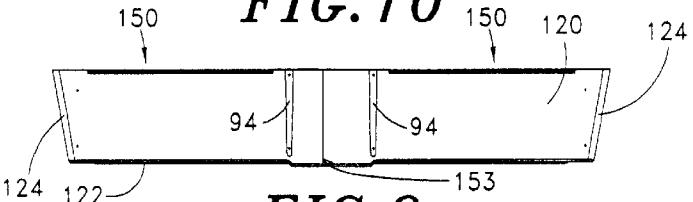
FIG. 9 is a side elevation view of the storage container of FIG. 8.

With reference now to FIGS. 8–11, the presently preferred container 36 will be described in detail. With reference initially to FIGS. 8 and 9, the container generally comprises four sidewalls 120 that are joined to a back wall 122. The sidewalls 120 preferably slope gently outward from the back wall 122 such that the opening defined at the forward ends of the sidewalls 120 is slightly larger than the size of the back wall 122. This sloping configuration slightly reduces residual stresses in the materials resulting from manufacturing. In addition, this sloping configuration aids in packing for shipping, as will be described below.

The sidewalls 120, at least in part, define the depth of the container 36. The corers 124 defined at the juncture of two adjacent sidewalls 120 are preferably reinforced to increase the strength of the container. The reinforcement is accomplished both by increased thickness at the corners as well as through the use of the corner brackets 72 described above. Preferably, the depth of the container combined with the mounting arrangement is such that an average automobile may be parked beneath the container when attached to an average height garage ceiling. Desirably, the bottom surface 122 of the container 36 extends no more than about 40 inches down from the mounting surface on the ceiling or rafters when assembled and mounted. Advantageously, however, to provide sufficient clearance, the bottom surface 122 is about 22 inches below the mounting surface. In yet another embodiment, the bottom surface is about 18 inches below the mounting surface. More preferably, the container is sized and configured to allow the disassembled container and components, with the exception of the hanging board, to be easily packaged and shipped via standard ground transportation. Thus, the disassembled container and components may fit within a 38 inch by 48 inch by 20 inch shipping carton. However, in another embodiment, the disassembled container and components occupy between about 11.5 cubic feet and about 15 cubic feet. Preferably, the disassembled components fit within a container having a combined length and girth of less than about 130 inches, wherein length is the longest side of the package and girth is the distance all the way around the package at its widest point perpendicular to the length. In one arrangement, such a container has a total length (i.e., the longest side) of less than about 108 inches. In some arrangements, the combined total of length and girth is less than about 84 inches. In yet other arrangements, the length of the longest side plus the distance around its thickest part is less than about 130 inches. In some arrangements, the packaged container has a weight of less than about 150 pounds. In other arrangements, the packaged container has a weight of less than about 70 pounds. Of course, the components forming the container and actuator assembly can have a weight of less than about 65 pounds, and more preferably about 55 pounds, in some arrangements. This sizing and weight advantageously conforms to size restraints placed on packages sent via ground carriers, such as U.P.S. and the United States Postal Service. Moreover, assembled, the container preferably has a storage volume of approximately 40. In some embodiments, the container may have a storage volume of between about 30 and about 106.

Figure 8A:
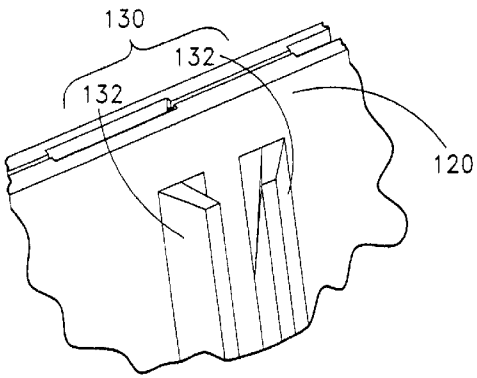
FIG. 8A is an enlarged perspective view of the portion of the storage container within 8A—8A in FIG. 8 illustrating the divider channel 130.
Figure 10:
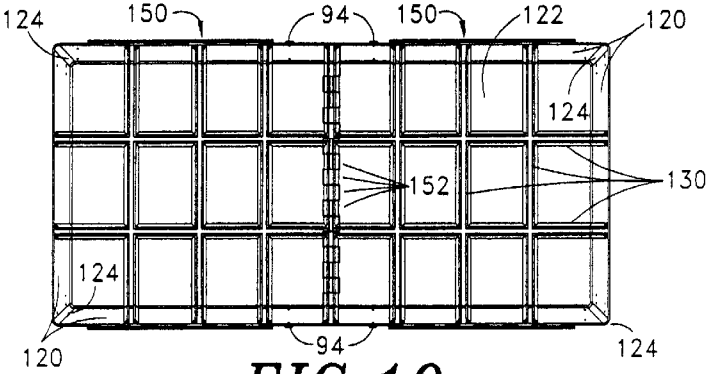
FIG. 10 is a top plan view of the storage container of FIG. 8.

With reference now to FIG. 10, the container 36 preferably is capable of being divided into any number of compartments. For this purpose, the container 36 includes a grid-like network of channels 130. As illustrated in FIG. 8A, the channels 130 are generally comprised of a pair of inwardly sloping walls 132 that extend upward from the surface of the sidewalls 120 and the back wall 122. Desirably, the channels 130 are sized and configured to accept dividers of a variety of lengths to customize the compartments to sizes and shapes as desired by any end user. Moreover, the channels, while depicted as generally continuous from one end to the other, may also be segmented as desired to reduce material usage and decrease cost. The channels also perform a reinforcing role in some embodiments, as the channel walls 132 add a ribbing effect to the container walls 120, 122.

Dividers 134 are sized and configured to be stably secured within the channels 130 as desired. The dividers enable efficient use of the storage space. For instance, the storage container 36 may be divided to hold skis and other elongated items in one portion while holding paint cans, tool boxes and other short or compact items in other portions. Such a configuration may appear as the configuration in FIG. 2. The divides may be formed in varied lengths and may be combinable in some embodiments to increase the total span of divider combination over that of any single divider. The dividers are preferably rigid and substantially non-yielding in manufacture. The dividers may be manufactured from metals, plastics, woods or other laminates, for instance. More preferably, the channel width is desirably sized to accommodate shelving commonly sold at hardware stores.

Figure 11:
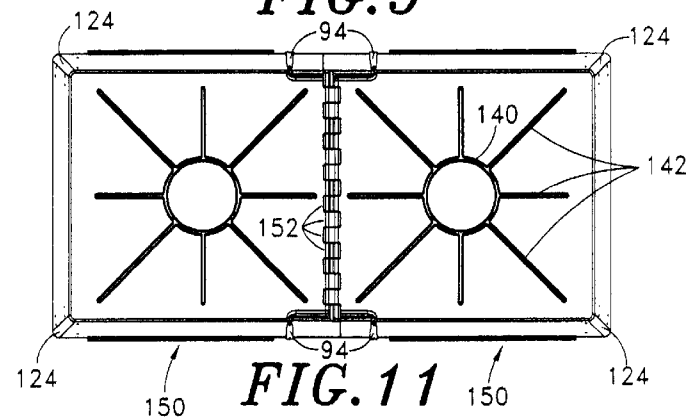
FIG. 11 is a perspective view bottom plan view of the storage container of FIG. 8.

With reference now to FIG. 11, a bottom view of the container 36 is illustrated therein. The container 36 of the present arrangement is preferably formed in two portions. The container is preferably manufactured of a fire-rated material, including a structural foam plastic, such that it may be easily molded for manufacture. Moreover, due to the ease of manufacturing and the price of raw materials, the use of plastics and structural foam materials is presently preferred. Such materials allow the product to be made efficiently at a reasonable cost per container. Some of these materials, however, do suffer from some drawbacks, such as reduced strength and rigidity. As such, each of the portions includes a reinforcing pattern on the back wall 122 of the container 36. The reinforcing pattern generally includes a ring 140 and a plurality of outward radiating ribs 142. The ring 140 reinforces in a similar manner to joining each of the ribs 142 in a center crossing point; however, the ring 140 reduces the amount of material required to achieve the reinforcing. In some embodiments, however, the ring 140 may be removed and the ribs 142 may be extended further inward. Preferably, the container is sized and configured to carry a payload of about 200 pounds. In a presently preferred embodiment, the container is sized and configured to carry a payload of approximately 350 pounds. In other embodiments, the container payload is approximately 500 pounds.

With continued reference to FIG. 11, the container 36 preferably is formed from two identical portions 150, as described above. Each portion preferably includes a plurality of serrated teeth 152 or other mating structures. As illustrated, the teeth 152 preferably extend the width of the back wall 122. Moreover, the teeth 152 are formed to allow the teeth of one portion 150 to mesh with the teeth 152 of the second portion 150 when the portions are turned toward one another to form a completed container. The teeth 152 may include a channel or tunnel (not shown) through each of the teeth such that a joining rod 153 (FIG. 9) may extend through the teeth to couple the teeth, and thereby the portions 150, together more securely. In this manner, the box portions are joined together in a hinge-type of connection. As also illustrated in FIG. 11, the sidewalls slightly overlap, but to varying degrees from one side to the other. In this manner, the complete container 36 may be formed by turning two identical portions, such as the portion illustrated in FIG. 11, toward one another and enmeshing the portions together. The central support brackets 90 then are assembled to the container. The brackets 90 securely connect the portions 150 together and define the pivot location 96 for the support arms 70 of the container 36.

Figure 12:
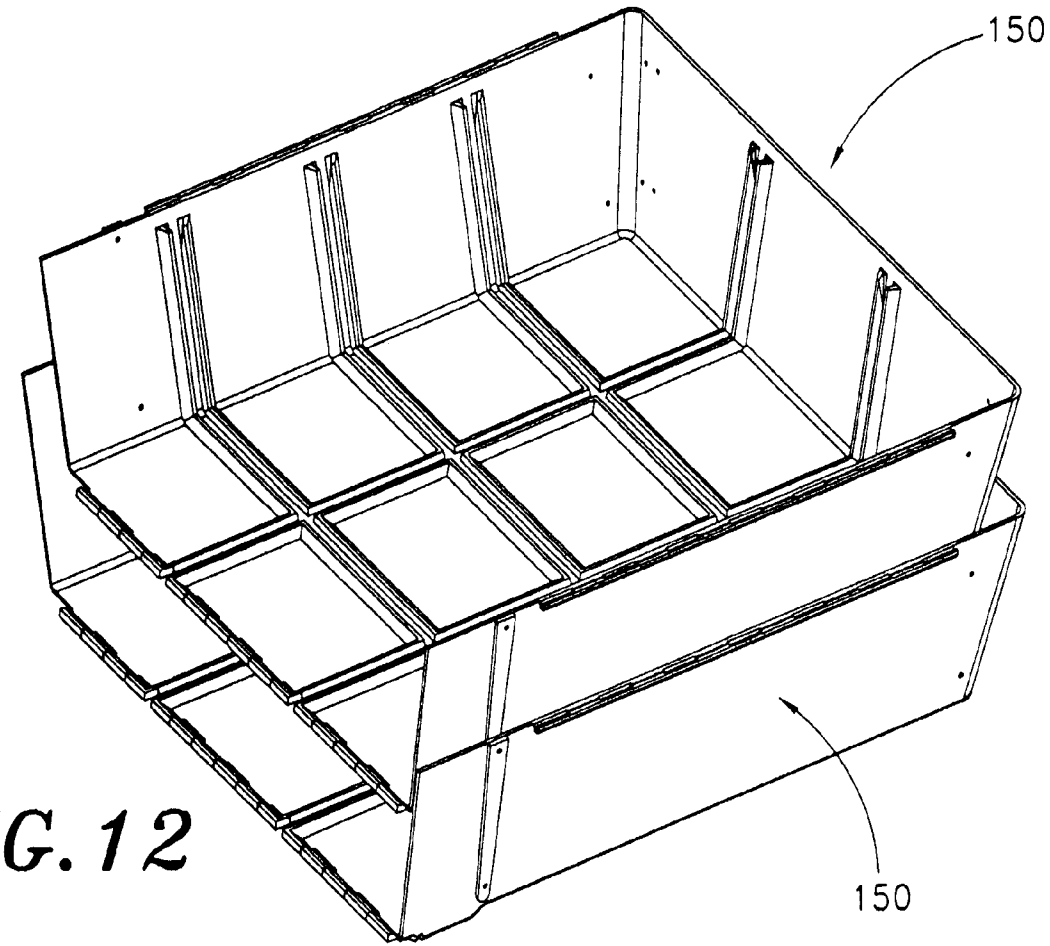
FIG. 12 is a nested arrangement for the portions of the storage container of FIG. 8.

With reference now to FIG. 12, the portions which form the container are preferably sized and configured to allow for space efficient nesting prior to assembly. In this manner, the portions 150 may be stacked for shipping, thereby increasing the number of components capable of being carried to distribution points from the manufacturing points by decreasing the amount of air which is ultimately "packaged" during shipping. The sloping sidewalls aid the efficient stacking by having a larger forward opening when compared to the back wall. Moreover, the nesting allows space efficient storage at the retail center.

In other arrangements, for example, in lower cost arrangements, the container can be manufactured in other manners. For instance, a plywood container could be assembled from a number of precut components. In some arrangements, the container could be assembled from components made from a variety of materials. For instance, the container could include a plastic bottom surface with wooden side walls. Moreover, in some arrangements, the container can be manufactured from a wire mesh or the like. Such a construction would be akin to the basket of a shopping cart. The container having the wire mesh basket would be lighter and less costly than the preformed plastic container described above. The wire mesh basket, however, would not protect the contents from dust, dirt and debris without protective liners or the like. An even less expensive arrangement can comprises a sheet of plywood or other suitable material instead of the box of the container. Items could be secured to the plywood sheet and the plywood sheet could be pivoted upward to stow the items.

Mounting the overhead storage device 30 is fairly efficiently performed due to the innovative design. The hanging board 40 first is positioned as desired and then secured to the ceiling or rafters 38 in the location using any suitable manner, including using lag bolts screwed into rafters 30 or using appropriate anchoring systems. With the hanging board 40 positioned and secured, the roller track 50 and the support brackets 52 are affixed to the hanging board 40. Of course, in some applications, the roller track 50 and the support brackets 52 can be affixed to the hanging board 40 prior to the hanging board being mounted to the ceiling. Because the illustrated overhead storage device has been designed to advantageously orient each of the components relative to the sides of the hanging board 40, alignment is straightforward and simple. Moreover, the components form a template for determining a placement of any fasteners used. Once the roller track 50 and support brackets 52 are secured, the worm drive 104 is rotated to position the follower nut 112 and cross axle 100 at the lowered stop position. The container 36 is assembled by joining the two portions 150 and mounting each of the brackets 72, 90 to the container 36. The completed container 36 is then raised up to the control arms 70 and mounted to the control arms 70. With the container 36 mounted to the control arms 70 and the support brackets 52, 72, the motor M may be turned on to drive the worm drive 104 such that the container 36 is raised to a closed position. For loading, the motor M may be turned on to operate the worm drive 104 such that the container 36 is lowered to an opened position. While this is the presently preferred mounting arrangement, many variations may also be envisioned.

Preferably, limit switches or the like are used to shut off the motor, or otherwise stop the movement of the box, when the container is in a desired position. The limits can be at the extremes of travel in one preferred arrangement. Multiple limits also can be used. Various control strategies have been envisioned to control the movement of the container. These strategies include a variety of stops, manipulation of travel direction and the like. In addition, the strategies can be employed mechanically or through a variety of electrical components and analogs (i.e., processors, software, hardware, etc.). Moreover, the strategies can be employed through either analog or digital technology.

Figure 24:
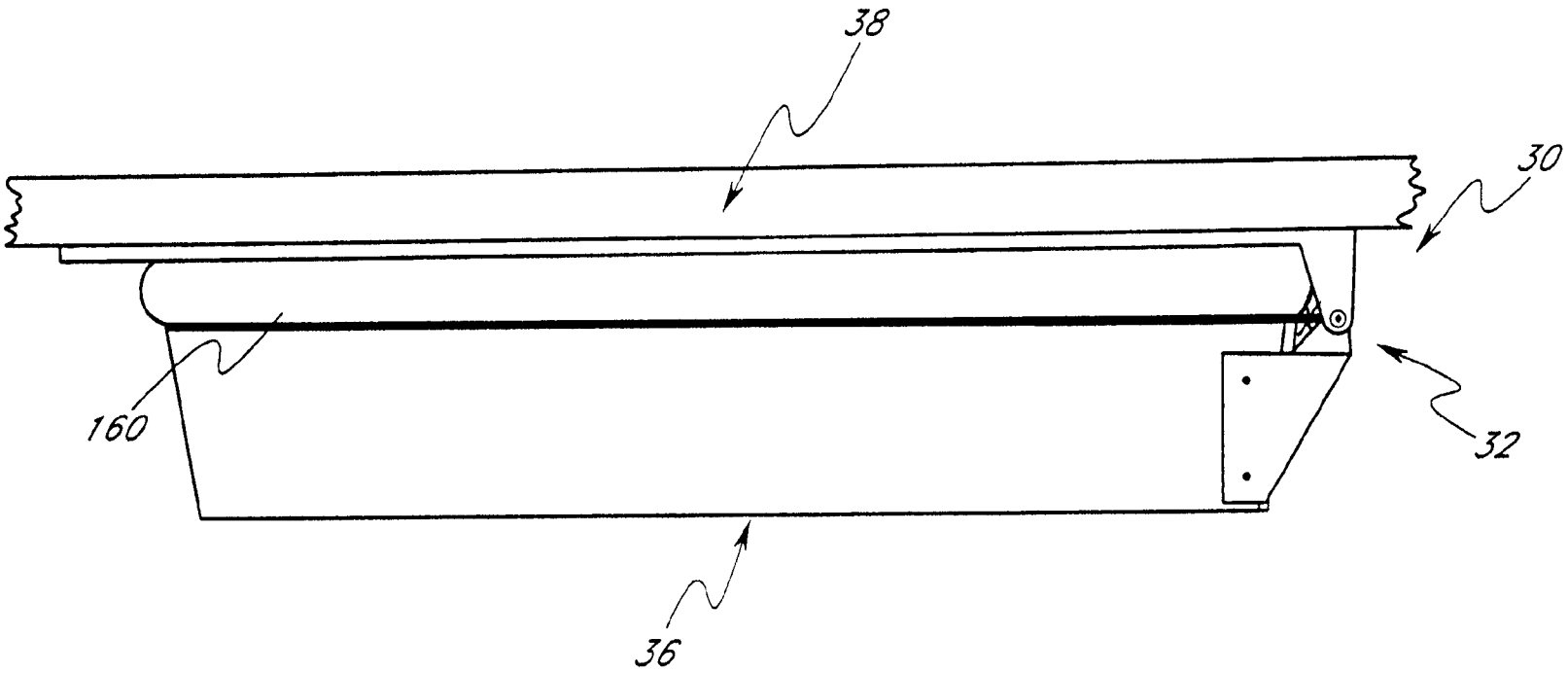
FIG. 24 is a simplified side elevation view of a container in a closed position featuring a sealing gasket interposed between an upper surface of the container and a lower surface of the sealing or mounting surface.

It is envisioned that many accessories may also be added to the storage device. For instance, a clear or cloth cover may be provided for the container. The cover may be secured along at least one of the edges of the container 36 and may be divided into separate flap portions that are able to be closed by zippers, tie strings, and the like. The cover may also be attached to the container with beads and tabs, snaps, buttons, or hook and loop fasteners such as Velcro or the like. The cover may protect stored items from dust and vermin infestation, for instance. In some arrangements, such as that illustrated in FIG. 24, the container 36 may include a gasket 160. The gasket can be attached to the container 32 or can be attached to the ceiling, such that the container 32 comes into contact with the gasket 160 when the container is in a closed position. In some arrangements, the gasket 160 can comprise an air filled compressible tube. In other arrangements, the gasket 160 can comprise a pliable rubber or elastomeric member, such as that used in the doors of automobiles or on the bottom of garage doors. The gasket 160 preferably is positioned such that the container or at least a portion of the container can be substantially sealed when the container 32 is in a closed position. The gasket 160 therefore can be used in conjunction with or as an alternative to the cover discussed directly above.

Another addition to the overhead storage device includes a remote control system CD whereby the positioning of the container 36 may be controlled via push buttons either hard wired into the control system or carried on a battery-powered hand control device. Any suitable remote control mechanism may be used. It is envisioned that a control system CD such as that used with a door-opening device may be used. The connection of such control devices CD to motors for controlling the motor are well known to those of ordinary skill in the art (i.e., garage door opening technology) and further description is deemed unnecessary.

Moreover, in the event a smaller capacity motor is used, a spring-biasing arrangement may be used to help carry the load of the container 36 during movement. For instance, a torsion-type spring may be used with one leg attached to the roller tracks 50 and the other attached to the container 36 in any suitable manner. The legs are preferably biased to return toward one another such that the spring may carry a substantial portion of the weight of the unloaded or loaded container as the container is moved between positions. Of course, other spring biasing configurations also may be used.

Figure 13:
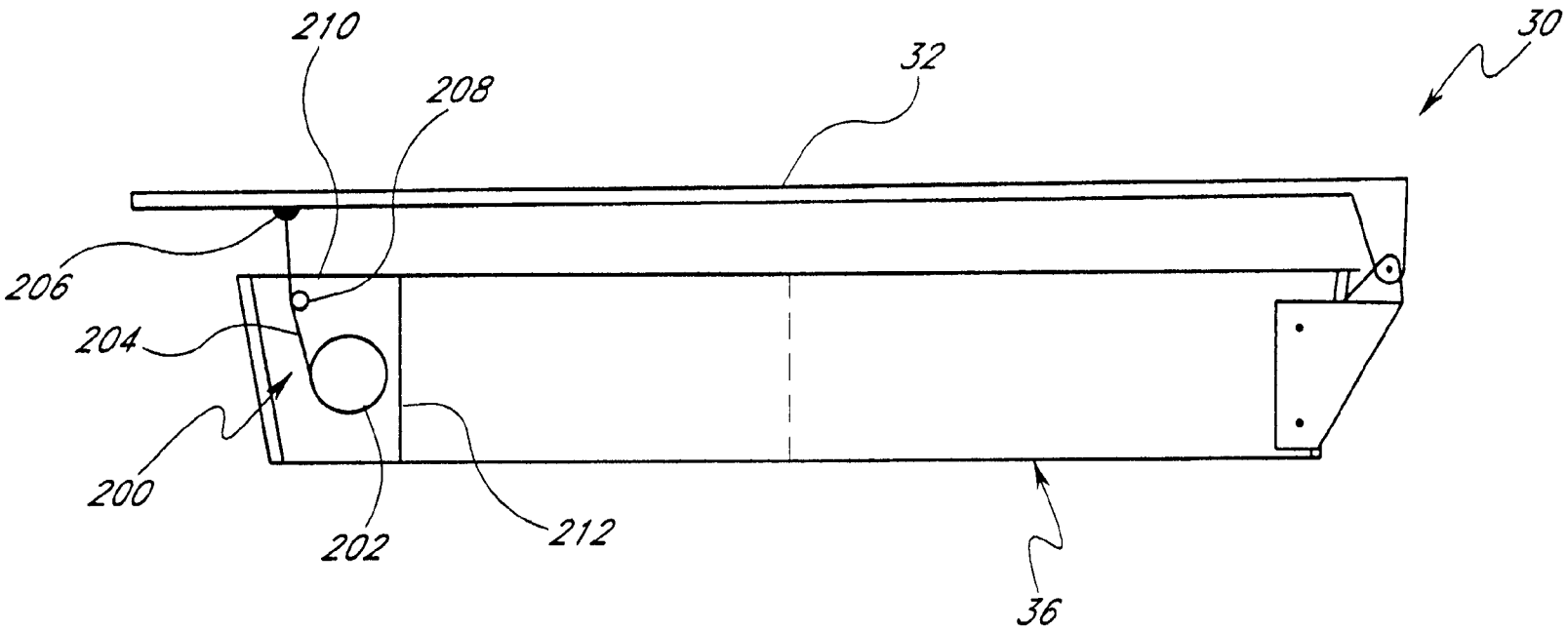
FIG. 13 is a schematic side elevation view of an overhead storage device configured and arranged in accordance with certain features, aspects and advantages of the present invention wherein the storage device utilizes a spooling cable arrangement.
Figure 14:
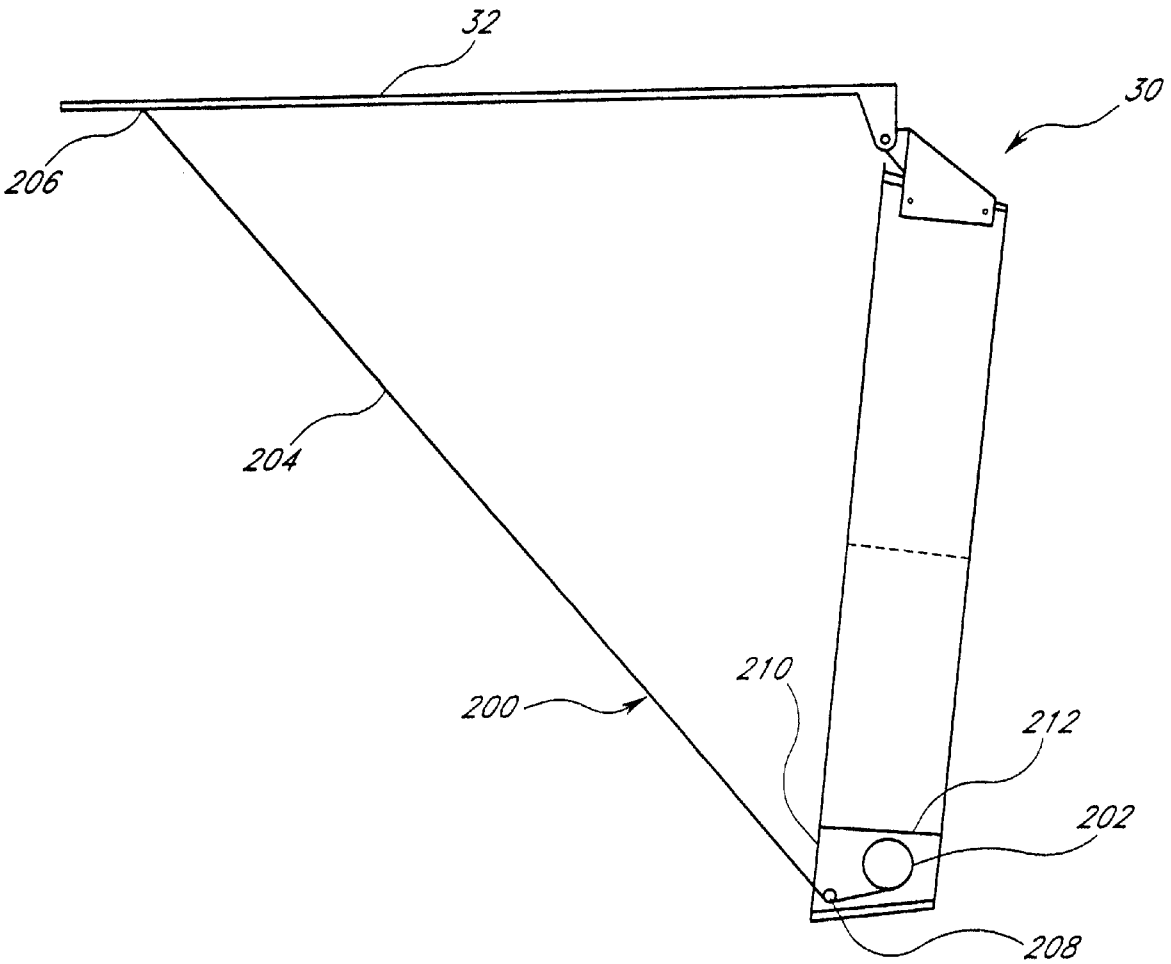
FIG. 14 is a schematic side elevation view of the arrangement of FIG. 13 shown in an opened position.
Figure 15:
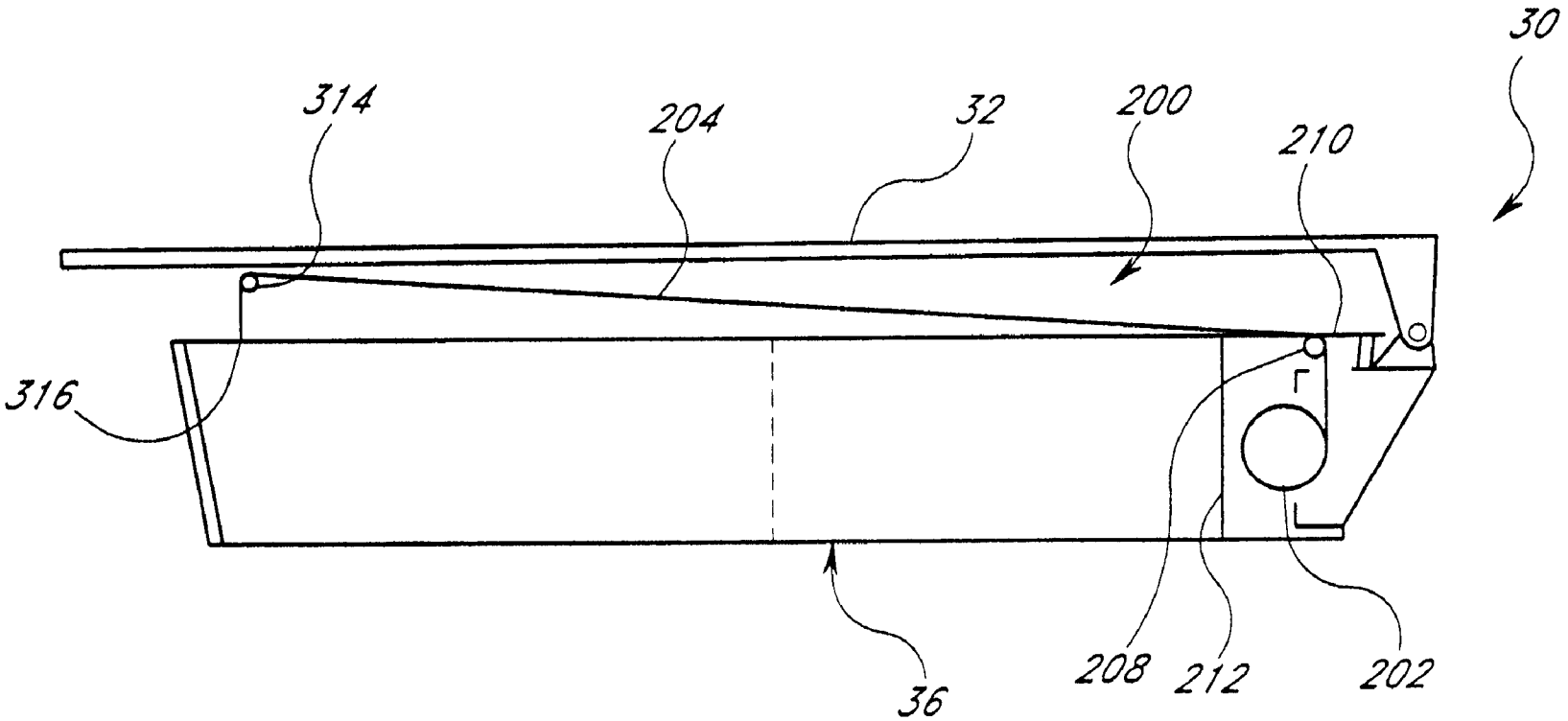
FIG. 15 is a schematic side elevation view of an overhead storage device configured and arranged in accordance with certain features, aspects and advantages of the present invention wherein the overhead storage device features a different spooling cable arrangement.
Figure 16:
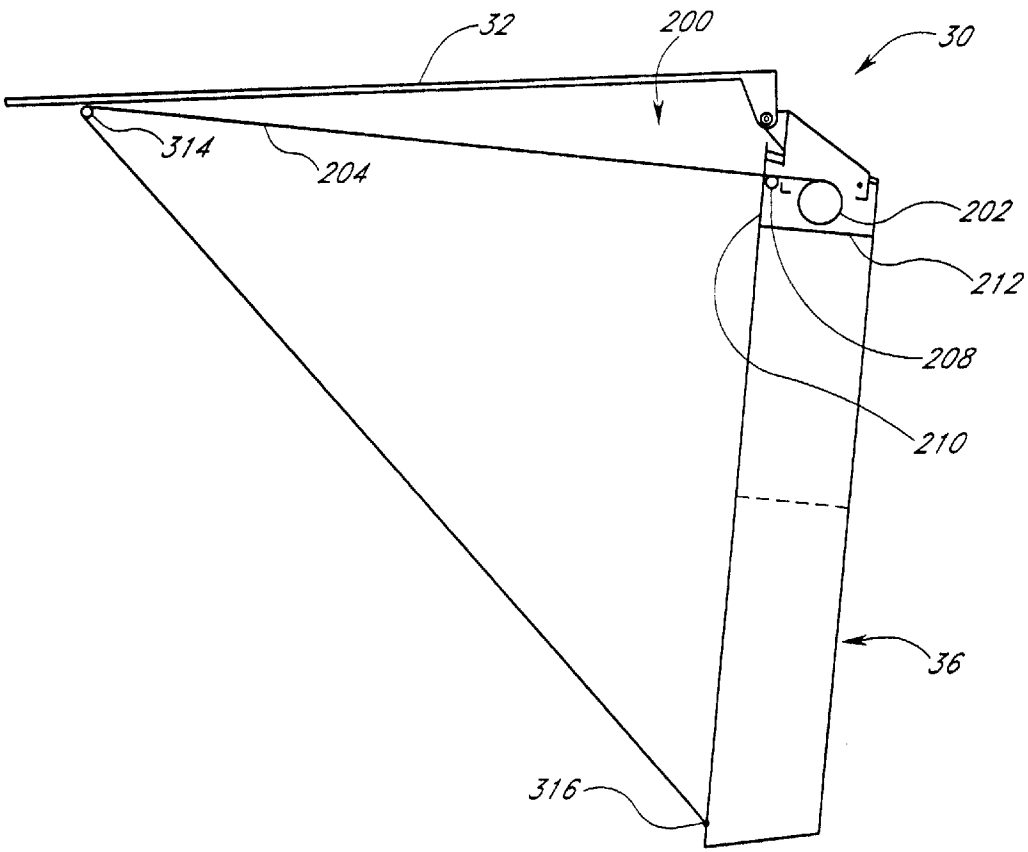
FIG. 16 is a schematic side elevation view of the arrangement of FIG. 15 shown in an opened position.

With reference now to FIGS. 13–23, additional arrangements of the overhead storage device 30 that use additional actuating assemblies 34 for moving the storage container 36 between the open and closed positions are illustrated. Each of the arrangements illustrated in these figures provides a storage container 36 that incorporates a belt and spool system or a spooling cable system 200 as the actuating assembly. In such an arrangement, a motor drives a spool around which a cable or belt is wound to raise the container to the closed position. In the illustrated arrangements, the motor can be provided in any of a number of locations. For instance, in the arrangements of FIGS. 13, 14, and 17–23, the motor is provided in the lower end of the container such that it is at the end of the container farthest from the pivot point of the container. In the arrangement of FIGS. 15 and 16, the motor is provided at the end of the container nearest the pivot point. It is also anticipated that the motor can be fixed to the ceiling; however, it is presently preferred that the motor is provided within the container to provide a simpler and neater esthetic appearance. In particular, it is presently preferred that the motor is provided at the end of the container farthest from the pivot location. While it would appear that placing the motor closest to the pivot location would reduce the load on the motor by the weight of the motor, positioning the motor in the opposite end (i.e., the end away from the pivot location) provides a simpler construction. Moreover, positioning the motor in this location provides a simpler line of force between the motor and the location on the ceiling to which the cable is attached.

With reference now to FIGS. 13 and 14, the storage container 36 incorporates the belt and spool system 200 which was described above. In this arrangement, a motorized spool 202 carries a portion of the belt that is wound around the spool. One end of the belt 204 is connected to the mounting assembly 32 or to the ceiling at an anchor point 206. The anchor point 206 can be directly attached to the ceiling without the use of a mounting assembly in some arrangements. In one particular configuration, the anchor point 206 is defined by an anchor plate that is mounted to the ceiling and provides a cable channel through which the cable can pass. Desirably, the length of the cable can be varied by pulling the cable through the cable channel and tightening a threaded fastener or stopping assembly to the cable. In other words, the length of the cable can be varied by pulling the cable through the channel and fastening a stopping member to the cable at a desired location. This advantageously allows one to alter the lengths of the cable to provide equal force in arrangements featuring more than one cable connection to a ceiling. It should be noted that in the illustrated arrangement, a pair of cables extend from opposite sides of the container to the ceiling. Accordingly, providing for adjustment of the cable lengths simplifies the assembly while allowing the weight of the container and any stored items to be spread or distributed evenly between the two cables.

By actuating the motorized spool 202 to rotate in a first direction, the belt 204 may be wound further onto the spool 202. By actuating the spool 202 to rotate in the opposite direction, the belt 204 may be unwound from the spool 202. By winding or unwinding the belt 204 to or from the spool 202, the storage container 36 can pivot toward the generally horizontal position or toward the generally vertical position as desired.

With continued reference to FIGS. 13 and 14, the belt-and-spool system 200 may further include a guide roller 208 located between the motorized spool 202 and the top end of the storage container 36. The belt 204 extends from the motorized spool 202, over the guide roller 208 and to the anchor point 206. Situated in this manner, the guide roller 208 maintains in a fixed or slightly varying position the point of intersection of the belt 204 with the plane defined by the upper face of the container 36, throughout the range of motion of the container 36. The guide roller 208 may advantageously be located as close as possible to the top end of the storage container 36 (or slightly above it) to minimize the variance of this intersection point.

A top cover plate 210 may overlie those portions of the belt-and-spool system 200 that are located within the storage container 36, and an end cover plate 212 may be included to separate the system 200 from the remainder of the storage container. The top cover plate 212 advantageously includes an opening (not shown) for each belt 204, and the inclusion of the guide roller 208 permits these openings to be of minimal size while permitting the necessary variance of the belt's intersection point with the top cover plate 210/upper face of the container 36.

By combining the storage container 36 and motor in a self-contained unit with an enclosure for the motor, the on-site (i.e., in the purchaser's home or business) assembly process is simplified and reduced in length. In other words, the purchaser/installer is not required to perform as much "overhead" work, such as hanging the motor from the overhead surface and connecting it to the worm drive. Furthermore, it is contemplated that the installation of the storage container 36 to the mounting assembly 32, and indeed the entire storage device installation process, can be performed by just one person, especially where the motorized spool 202 is located opposite the pivot axis of the container 36 (as seen in FIGS. 13A–13B). This may be done by first installing the mounting assembly 32 to the overhead surface, and then hanging the container from the mounting assembly by holding the container by the free end (i.e., the end opposite the pivot axis) and aligning the opposite end to the support bracket 52 (see FIG. 2) of the mounting assembly 32.

As with the motor M described with reference to FIGS. 1–12, the motorized spool 202 incorporates a motor that is preferably electric. More preferably, the motor M is powered by 110-volt power; a channel (not shown) may be incorporated in the container 36 to accommodate an electric cord extending from the motorized spool 202 to the opposite end of the container, near the pivot axis thereof. One example of a presently preferred motor is one such as that used in a treadmill or on a hospital bed. The motor is preferably a medium speed, high torque motor. For instance, the motor can turn at a rate between about 400–1100 rpm in some applications, depending at least in part upon the diameter of the spool(s) driven by the motor. In one configuration, the motor may have rotational braking to ensure that the container cannot move unless intended. It is also envisioned that any of a variety of latching mechanisms can secure the container in any desired position.

The motor is mechanically connected to one or more spools to form the motorized spool 202. Each spool is preferably situated so as to rotate about an axis that is substantially parallel to the pivot axis of the storage container 36; however the spool(s) may alternatively be situated so as to rotate about an axis that is oriented collinear or substantially parallel to a longitudinal axis of the container 36, or otherwise. The motorized spool 202 preferably comprises two spools located near either side of the container 36 or a single, centralized spool, although alternative numbers and locations are possible and are considered to be within the scope of the present invention. Each spool has an associated belt, guide roller, etc. It is preferred that a single motor drives all of the spools in the motorized spool 202 although each spool may be driven by a dedicated motor if desired.

In the illustrated arrangement, a pair of limit switches L are provided to shut off the motor once the container 36 has been moved to a desired position. In one arrangement, at least one switch L can be mounted to the ceiling such that a portion of the container contacts the switch L to actuate the switch and shut off the motor M. In another configuration, at least one switch L can be mounted to the container such that the switch can contact a contact surface mounted to the ceiling or mounting surface. Of course, optically triggered switches, contact switches, toggle switches and the like can be adapted for use with the present container arrangement.

The belt 204 preferably comprises a canvas or nylon belt, of suitable thickness and width to withstand the loads encountered in moving the container 36 between the substantially vertical and substantially horizontal positions. Of course, any flexible transmitter can be used. For instance, the flexible transmitter can be made from a wide variety of materials, so long as it is sufficiently strong, flexible and resilient to move and support the container as needed, and wind around the motorized spool 202. Thus as used herein the term "belt" or "flexible transmitter" refers to any structure that meets the above-stated performance criteria, and thus encompasses, for example, a cable, rope, heavy tape, etc. Preferably, the belt has a profile that is thin relative to its width, so that the belt does not substantially increase the diameter of the spool as the belt winds upon it. This thin-profile belt is preferable to a cable-type belt, which would quickly add to the spool diameter if wound onto a spool that is only wide enough to accommodate one belt width, or would require a level-wind mechanism to ensure (laterally) even winding of the cable-type belt onto a spool that is significantly wider than the belt.

With reference now to FIGS. 15 and 16, another arrangement of the storage device 30 is illustrated that comprises the belt-and-spool system 200 to move the container 36 between the open and closed positions. This arrangement is similar to that of FIGS. 13 and 14, with some differences detailed below. In this arrangement, the motorized spool 202 is located near the pivot axis of the container 36, and the belt 204 runs over the guide roller 208 and a support roller 314 that can be attached to the ceiling or to the mounting assembly 32 near an end of the container 36 opposite the pivot axis. The belt 204 attaches to the container 36 at an attachment point 316 below the support roller 314. As with the arrangement of FIGS. 13 and 14, by actuating the motorized spool 202 to rotate in a first direction, the belt 204 may be further wound onto the spool 202 and the container 36 can be caused to pivot toward the substantially horizontal position. By actuating the motorized spool 202 to rotate in the opposite direction, the belt 204 is unwound from the spool, causing the container 36 to pivot toward the substantially vertical position. Thus, in opening/closing the storage device 30 shown in FIGS. 14A–14B, the motorized spool 202 increases (in the case of opening) or decreases (in the case of closing) the size of a belt loop extending between the attachment point 316 and the spool 202.

Figure 17:
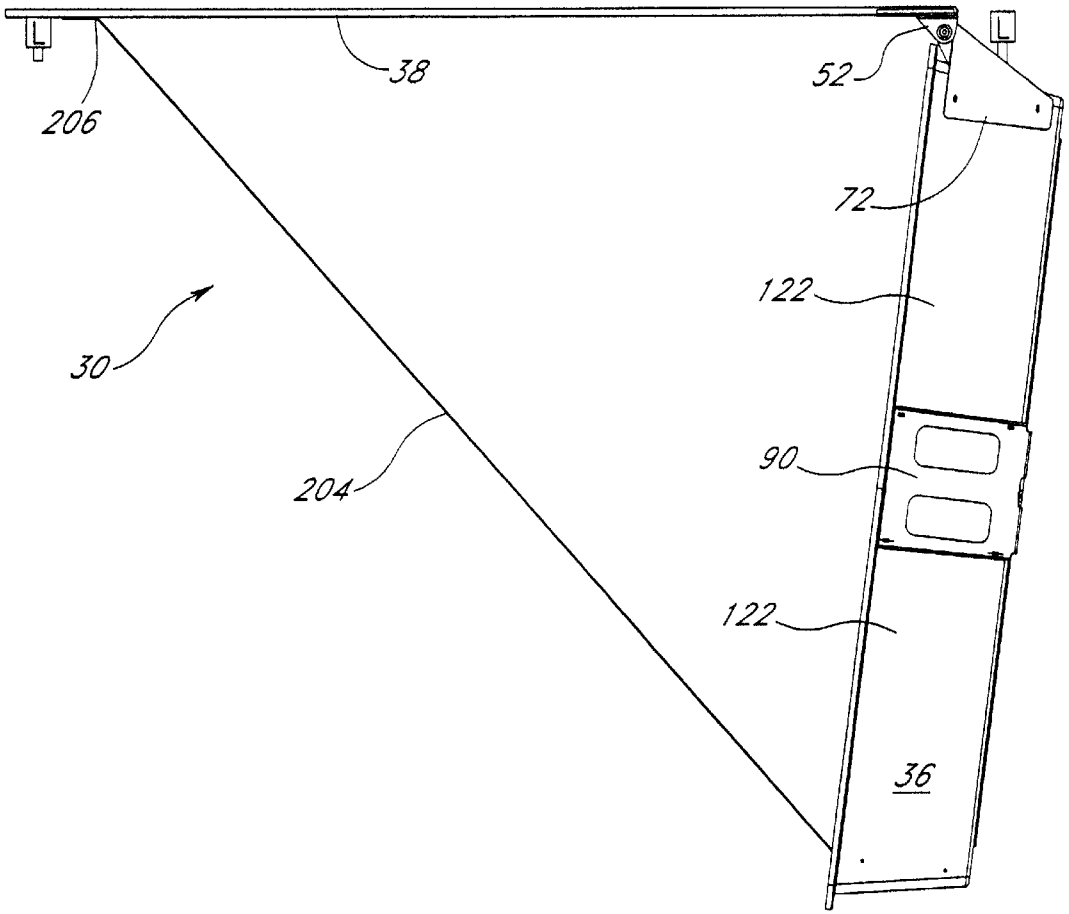
FIG. 17 is a side elevation view of an arrangement similar to that of FIG. 13 illustrated in an open position.
Figure 18:
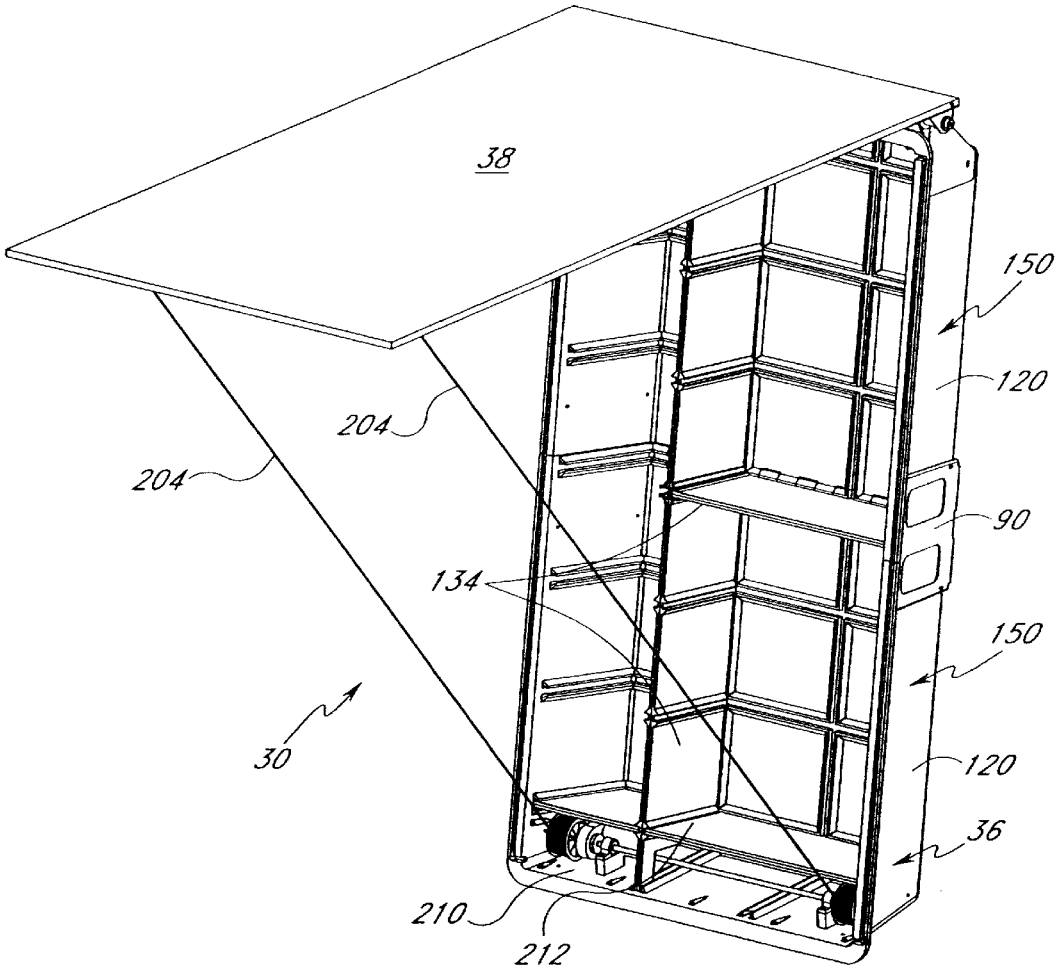
FIG. 18 is a perspective illustration of the arrangement of FIG. 17.
Figure 19:
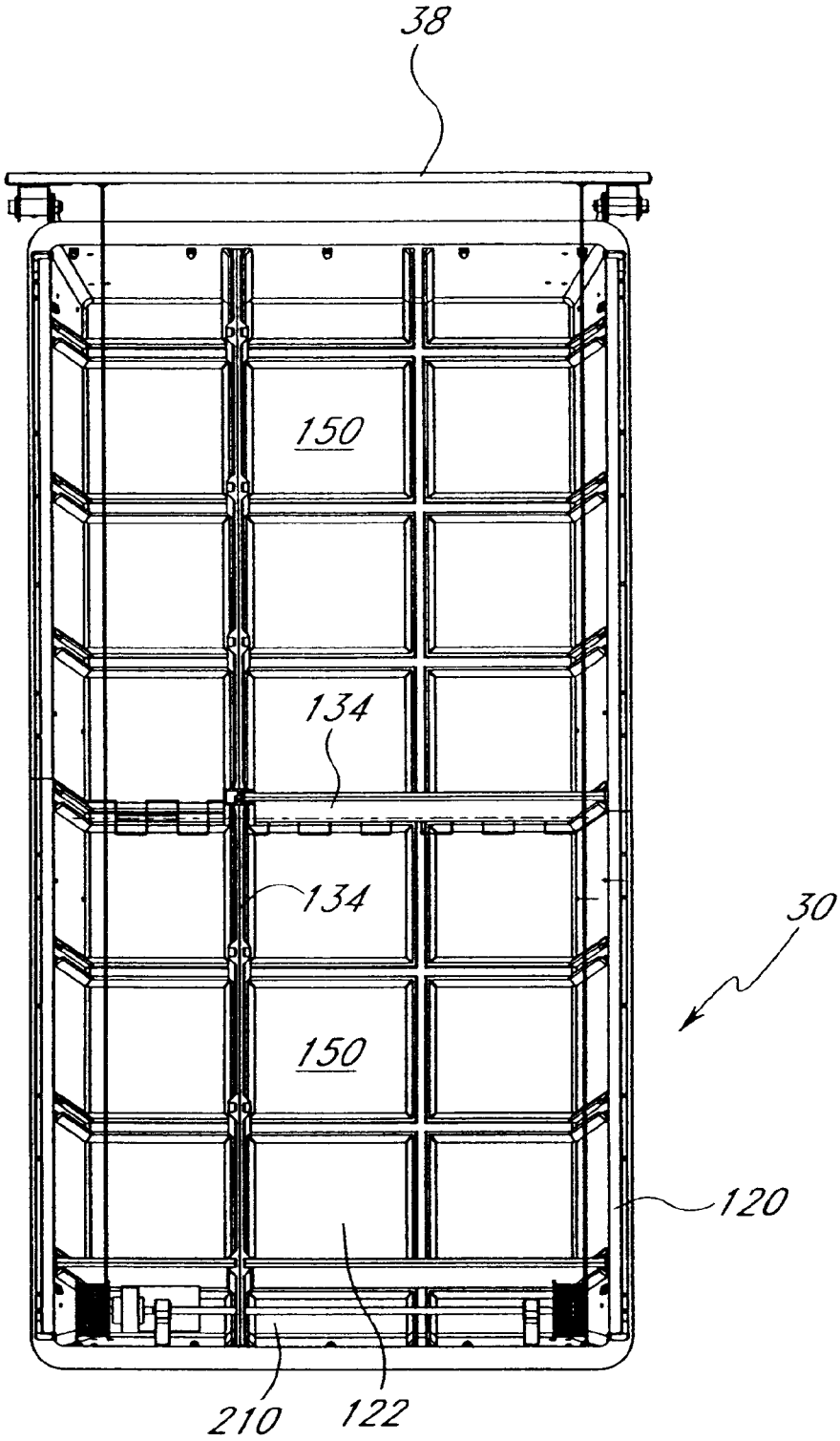
FIG. 19 is a front elevation view of the arrangement of FIG. 17.
Figure 20:
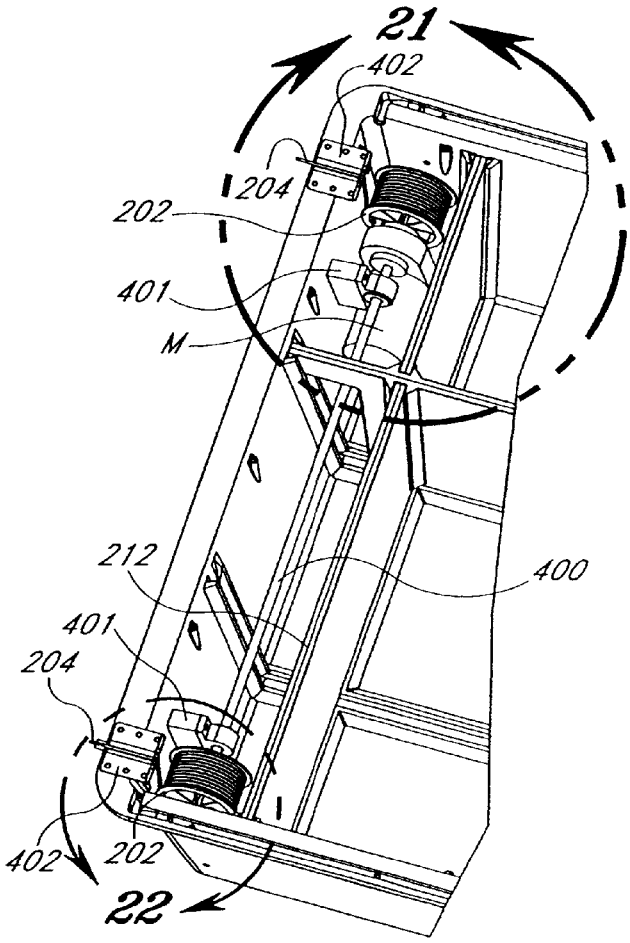
FIG. 20 is a partial perspective view of the drive arrangement of FIG. 17.
Figure 22:
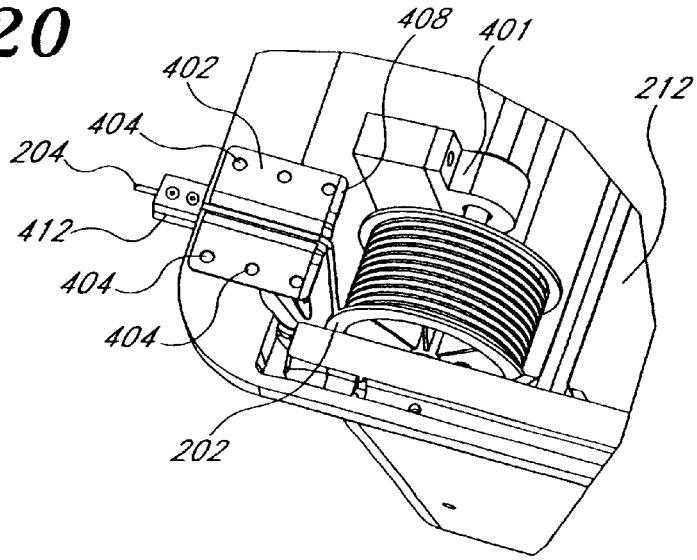
FIGS. 21 and 22 are enlarged perspective views of the spooling arrangements of FIG. 20.
Figure 21:
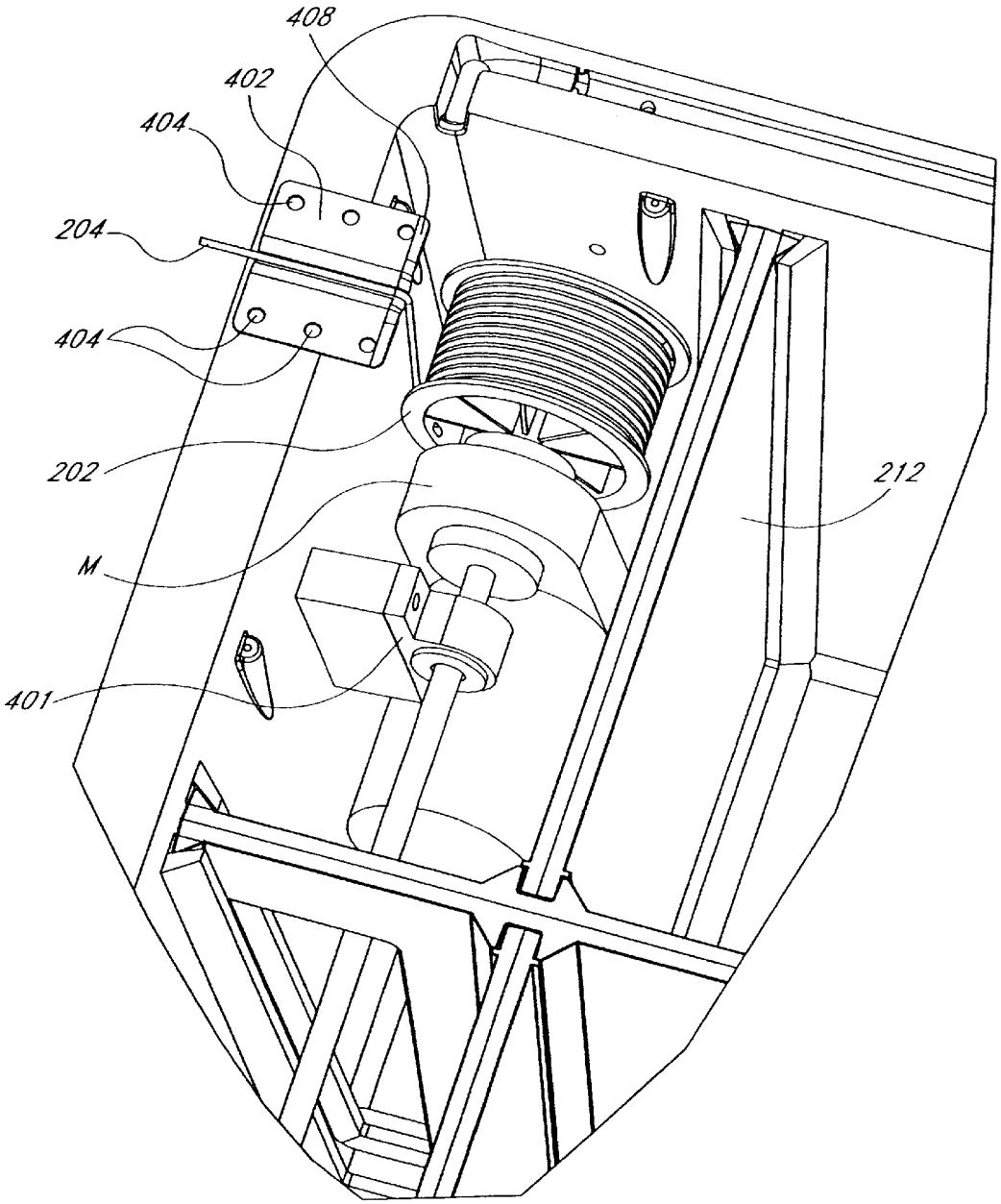

With reference now to FIGS. 17–23, an arrangement similar to that of FIGS. 13 and 14 will be described in more detail. As illustrated in FIGS. 17 and 18, a pair of cables 204 are secured to a ceiling 38 or any other suitable mounting structure at an anchor point 206. In the illustrated arrangement, the anchor point 206 is provided by a plate or a hook to which the cable can be adjustably connected. Preferably the adjustment allows the two cables to be adjusted to substantially the same length such that the load on each of the cables is roughly equal. The cables 204 then extend into a compartment defined by the wall 212 and covered by the cover plate 210. Within this compartment are contained a motor M and a pair of spools 202 in the illustrated arrangement.

With reference now to FIGS. 20–23, the connection between the motor and the spools will be described in more detail. In the illustrated arrangement, the motor M is provided with a dual output shaft 400. The dual output shaft 400 extends to both of the spools 202. In the presently preferred arrangement, the motor M is a gear motor that has the dual output shaft. Of course, in some arrangements, the dual output shaft 400 could be coupled to a drive shaft through any suitable coupling member. In addition, while it would be more complicated, a transmission could be used such that a single direction motor could be used to power the actuating assembly, both in a forward direction and in a reverse direction. In some configurations, the motor M is coupled to a drive shaft through the use of a drive belt arrangement. In this configuration, the drive belt would loop around a drive pulley that is attached to the shaft 400 and a driven pulley that is attached to the drive shaft, thus the belt would transfer motion from the output shaft 400 of the motor M to a drive shaft to which the spools 202 are connected. In the illustrated arrangement, the shaft 400 is supported at two locations through the use of pillow block bearings 401. Of course, the shaft can be supported in other suitable manners. For instance, the shaft could pass through bushings or ride plates over which the shaft could turn and be supported. Additionally, in some applications, the shaft may be rigid enough to not require supports. Furthermore, in other configurations, the shaft may be manufactured from a light enough material that it requires support at more than two locations. Accordingly, those of ordinary skill in the art will recognize that the support of the shaft depends upon the selection of the material as well as the sizing of the shaft, and the supports can be configured accordingly. Advantageously, the supports are provided in the illustrated arrangement nearest the points of high bending forces (i.e., next to the motor and next to the spools 202).

Figure 23:
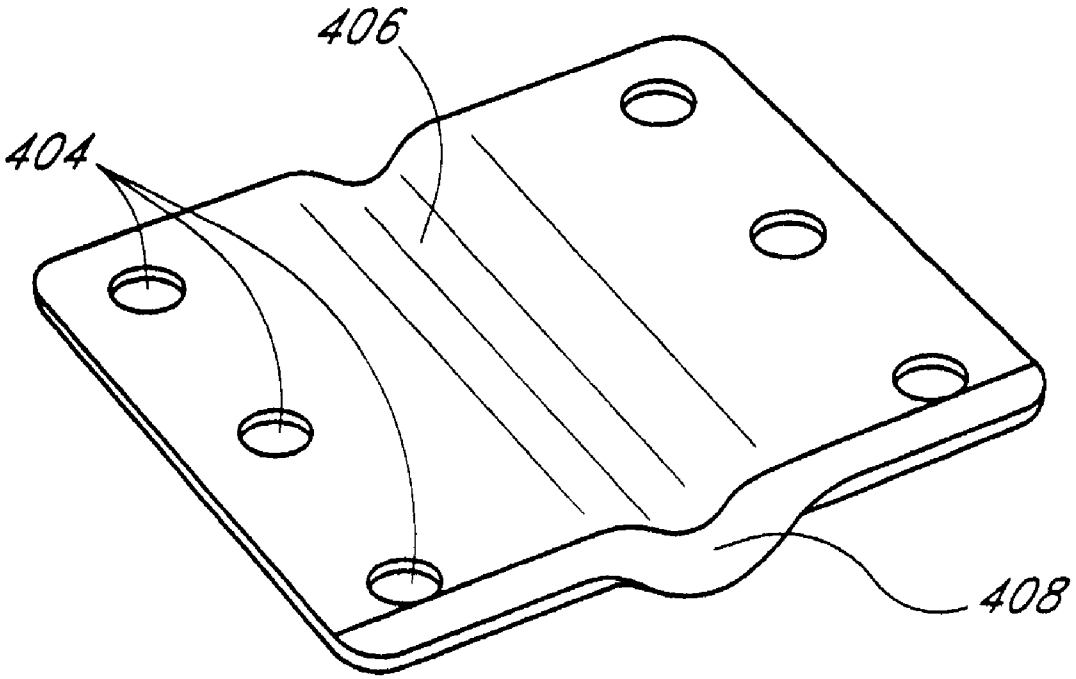
FIG. 23 is an enlarged perspective view of a cable plate used in the arrangement of FIG. 17.

With reference now to FIGS. 20–23, the spools 202 carry the cable 204 as it is wound up on the spool 202. The cable preferably passes across a cable guide plate 402. The cable guide plate 402 preferably contains a number of mounting apertures 404 that can be used to connect the cable guide plate 402 to the ceiling or other mounting surface 38. Additionally, the illustrated cable plate, as best illustrated in FIG. 23, features a central channel 406. The central channel 406 accommodates the cable 204 and provides a location through which a cable can extend. The end of the channel 406 in the illustrated arrangement features a down-turned lip 408. The lip 408 provides a smooth transition of the cable to the spool 202. The lip 408 advantageously reduces the shearing forces exerted on the cable 204 as the cable is drawn onto the or off of the spool 202. Accordingly, in the illustrated arrangement, a cable clamp 412 can be added to the cable 204 on the end of the cable plate opposite the end of the cable plate closest to the spool 202. The clamp 412 secures the position of the cable 204 relative to the guide plate after the guide plate 402 has been secured to the ceiling or other mounting surface. Thus, the cable is fixed in a location relative to the ceiling through the use of the plate 402 and the clamp 412 in the illustrated arrangement.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

We claim:

1. An overhead storage device comprising a storage container, a frame pivotably connected to said storage container and adapted to be connected to an overhead surface, said storage container comprising at least one sidewall and a bottom wall, a reference plane defined generally parallel to said bottom wall and extending through said at least one sidewall, a motorized actuator connected to said storage container, said motorized actuator capable of controllably pivoting said storage container relative to said frame such that the reference plane moves between a generally horizontal position and a generally vertical position.

2. The device of claim 1, wherein said storage container is connected to said frame both at a pivot location and by two support arms.

3. The device of claim 2, wherein said motorized actuator includes a worm drive connected to said support arms.

4. The device of claim 2, wherein said support arms each carry a rolling assembly that cooperates with said frame whereby each said rolling assembly rolls along the frame to allow an end of each support arm to translate along said frame.

5. The device of claim 1, wherein said frame is adapted to be connected to the overhead surface by a mounting board.

6. The device of claim 5, wherein said mounting board is formed by a single sheet of material.

7. The device of claim 1, wherein said mounting board is a four foot wide by ten foot long sheet of material.

8. The device of claim 1, wherein said motorized actuator comprises a motorized flexible transmitter-and-spool system interconnecting said storage container and said overhead surface, said flexible transmitter-and-spool system being capable of controllably pivoting said storage container relative to said frame such that the reference plane moves between a generally horizontal position and a generally vertical position.

9. An overhead storage device comprising a storage container, a mounting assembly being adapted to movably secure said storage container to an overhead surface, a motorized actuating assembly at least partially controlling the movement of said storage container between a generally open position and a generally closed position, said storage container comprising at least one sidewall and a bottom wall, a plurality of ribs reinforcing said bottom wall, and an intersecting grid of channels extending along said sidewall and said bottom wall, said grid configured to removably receive dividing panels whereby said storage container may be subdivided into individual compartments.

10. The device of claim 9, wherein said storage device is sized and configured such that said storage device has a total height in the closed position of less than approximately 24 inches.

11. The device of claim 9, wherein said storage device is sized and configured such that said storage device has a total height in the closed position of less than approximately 40 inches.

12. The device of claim 9, wherein said sidewall is sloped relative to a plane extending normal to said bottom wall.

13. The device of claim 9, wherein an opening is defined by said sidewall and said opening is larger than a periphery of said bottom wall.

14. The device of claim 13, wherein said storage container is comprised of two identical sections that are joined together at a central plane extending through said storage container.

15. A method of assembling an overhead storage device comprising positioning a mounting board on an overhead surface;

securing said mounting board to said overhead surface;

positioning and securing components of a frame on said mounting board by using said mounting board as a spacing template;

assembling a storage container;

mounting said storage container to said frame; and connecting a motorized actuator to said container.

16. A kit for building and mounting an overhead storage system, said kit comprising a container, a motor, a drive mechanism that connects to said motor, and a mounting assembly that comprises tracks, rollers and control arms, wherein the kit fits within an envelop of 38 inches wide by 44 inches tall by 15 inches deep.

17. The kit of claim 16, wherein the kit has a weight of less than about 150 pounds.

18. The kit of claim 16, wherein the kit has a weight of less than about 65 pounds.

19. The kit of claim 16, wherein the kit includes a single sheet mounting board.

* * * * *